United States Patent [19]

Wells

[11] Patent Number: 5,058,669

[45] Date of Patent: Oct. 22, 1991

[54] EXTRACTION SYSTEM WITH A PUMP HAVING AN ELASTIC REBOUND INNER TUBE

[75] Inventor: Samuel L. Wells, Lilburn, Ga.

[73] Assignee: Westinghouse Electric Corp., Pittsburgh, Pa.

[21] Appl. No.: 581,939

[22] Filed: Sep. 13, 1990

Related U.S. Application Data

[63] Continuation of Ser. No. 326,368, Mar. 21, 1989, Pat. No. 4,974,674.

[51] Int. Cl.[5] ..... E21B 43/00

[52] U.S. Cl. ..... 166/107; 166/167; 417/478; 210/242.3

[58] Field of Search ..... 166/54.1, 105, 107, 166/165, 167, 105.6, 166; 417/394, 478, 479; 210/242.3

[56] References Cited

U.S. PATENT DOCUMENTS

| | | | |
|---|---|---|---|
| 3,690,463 | 9/1972 | O'Brien | 210/242.3 |
| 4,257,751 | 3/1981 | Kofahl | 417/394 |

FOREIGN PATENT DOCUMENTS

| | | | |
|---|---|---|---|
| 2410093 | 7/1979 | France | 210/242.3 |
| 0005974 | 10/1987 | PCT Int'l Appl. | 417/478 |

*Primary Examiner*—Terry L. Melius
*Attorney, Agent, or Firm*—G. H. Telfer

[57] ABSTRACT

An elastic rebound pump comprises a flexible inner tube having a substantial elastic rebound surrounded by a pump housing. The inner tube defines an inner chamber and the pump housing forms an outer chamber for confining a pump fluid. The pump allows pressurized gas or hydraulic fluid into the outer chamber to collapse the inner tube thereby discharging liquid from the inner chamber through an outlet opening. The pump alternatively releases the pressurized fluid from the outer chamber thereby allowing the inner tube to rebound to a full configuration and draw liquid into the inner chamber through the inlet opening. By repeatedly allowing pump fluid into the outer chamber and sequentially releasing the pump fluid from the outer chamber, the pump produces a substantially steady flow of liquid. An extraction pump system includes the elastic rebound pump for removing liquid hydrocarbons from ground water collected in a well. The elastic rebound pump fits easily into small diameter wells and can be suspended above the liquid hydrocarbons in the well. An alternative extraction pump system includes a submerisble pneumatic pump positioned within the ground water in the well for creating a cone of depression, and the elastic rebound pump and the submersible pump are driven simultaneously. In another disclosed extraction pump system, the elastic rebound pump is suspended within the housing of the submerged pneumatic pump. In still another disclosed extraction pump system, the elastic rebound pump is driven with pressurized ground water from a submersible pump.

20 Claims, 6 Drawing Sheets

Fig_6
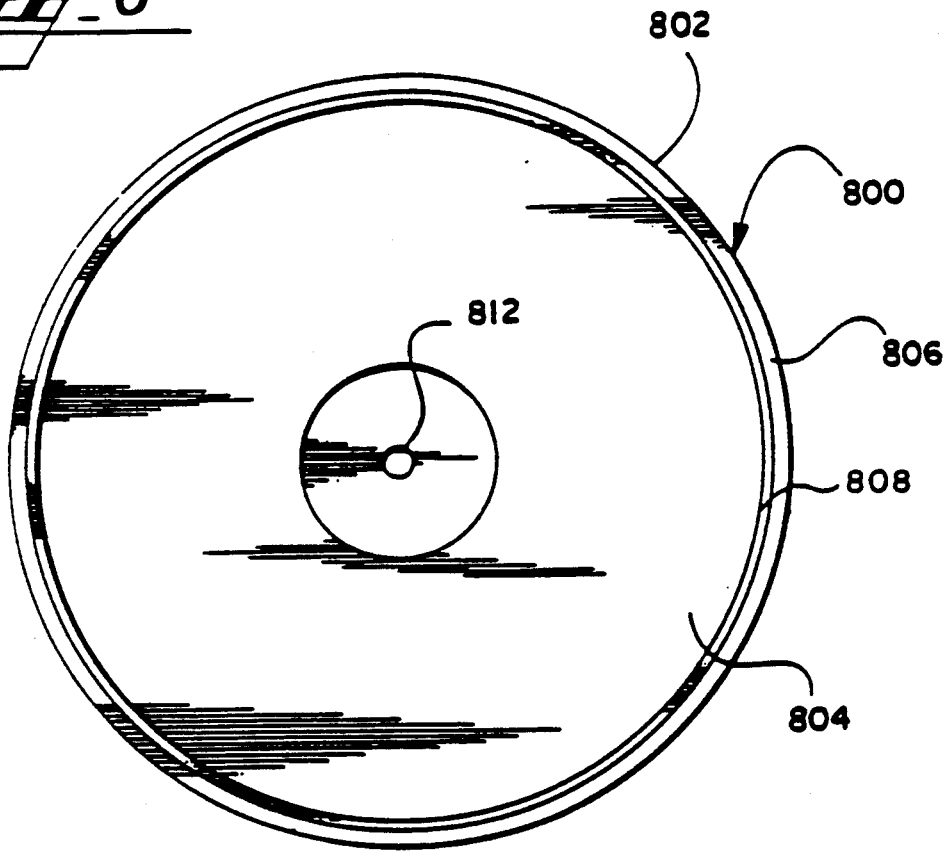
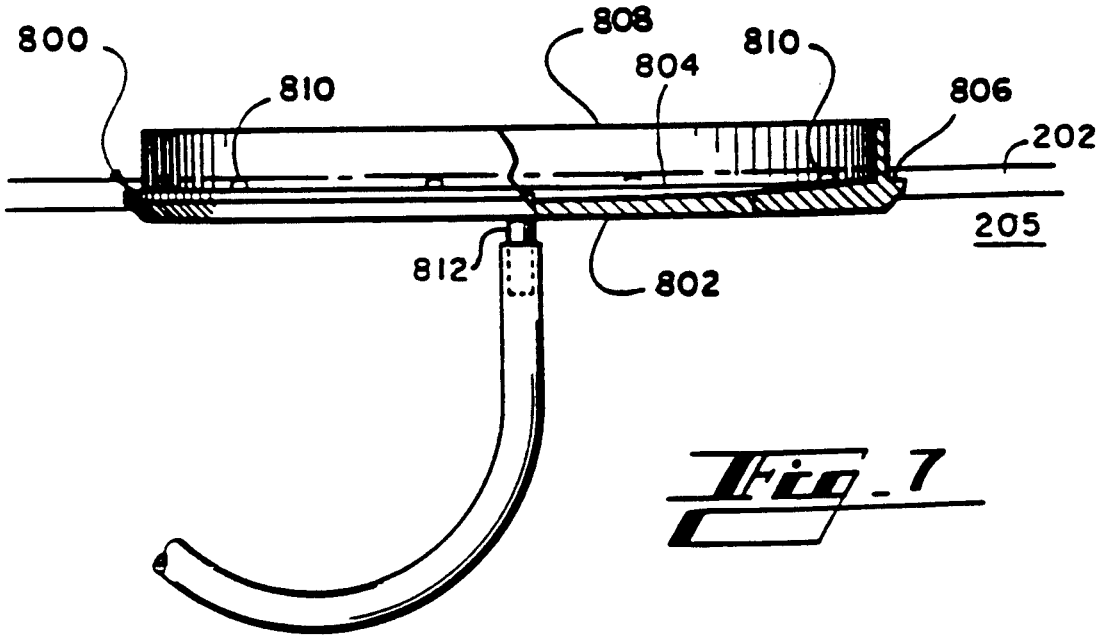
Fig_7

EXTRACTION SYSTEM WITH A PUMP HAVING AN ELASTIC REBOUND INNER TUBE

This is a continuation of application Ser. No. 07/326,368 filed Mar. 21, 1989, now U.S. Pat. No. 4,974,674, issued Dec. 4, 1990.

TECHNICAL FIELD

This invention relates generally to extraction systems for recovering liquid hydrocarbons from ground water, and more particularly relates to pumps used in extraction systems.

BACKGROUND OF THE INVENTION

At petroleum handling facilities such as refineries, storage facilities, terminal facilities, and gasoline stations, spillage of liquid hydrocarbons can result in the contamination of subsurface or surface ground water in the immediate vicinity. The problem of ground water contamination can occur as a result of slow leakage over time or as a more catastrophic spillage event. In either case, the liquid hydrocarbons can seep through the ground to the ground water table level or collect in open streams or ponds. Because liquid hydrocarbons have specific gravities that are less than water and are generally immiscible with water, liquid hydrocarbons often form a layer on top of the ground water table.

After a catastrophic spill, the liquid hydrocarbons tend to form an especially thick layer on top of the ground water table at the point directly below the spill. In order to exploit the fact that the liquid hydrocarbons are in a relatively concentrated area beneath the point of the spill, and before the liquid hydrocarbons have dispersed due to their own hydraulic head and general ground water flow, it is advantageous to make a well bore at the point of the spill and pump as much of the liquid hydrocarbon out of the well bore as soon as possible. Early removal of the concentrated liquid hydrocarbons reduces the hydraulic head of liquid hydrocarbons and helps minimize the lateral spreading of the contamination.

Normally where ground water clean-up is to be undertaken, it is necessary to acquire permits from environmental protection agencies before the decontaminated ground water can be discharged from the site. In most spillage cases where the public health and safety are not immediately affected, there may be administrative delays in acquiring such permits and until such permits are acquired, any water that is pumped to the surface must be stored or trucked away to an approved disposal treatment site until such time as the requisite permit to discharge the ground water has been acquired. It is therefore important, during the early phase of a clean up of a catastrophic spill, while the liquid hydrocarbons remain concentrated beneath the spill and when no discharge permit is available, to pump the minimum amount of ground water as a percentage of the liquid hydrocarbons to the surface. In order to exploit the situation, the intake of the pump must be located within the liquid hydrocarbon layer so that the smallest amount of ground water is pumped to the surface.

Skimming vessels which float in the liquid hydrocarbon layer have been used to collect the liquid hydrocarbon. A conduit, such as a coiled tube, connected to the skimming vessel, conducts the liquid hydrocarbon in the skimming vessel to the intake of a pump. Such pumps conventionally rely on the head created by the height of the liquid hydrocarbon to force the liquid hydrocarbon through the intake of the pump and fill the pump chamber. Accordingly, these conventional pumps were located below the skimming vessel and within the ground water. Because these conventional pumps must be positioned within the ground water, there is a risk of the ground water seeping into the liquid hydrocarbons as the liquid hydrocarbons are removed by the pump. There is the further risk of the liquid hydrocarbons in the well bore corroding the outer surface of the pump. In addition, these conventional pumps are normally too large for smaller diameter (2–4 inches) well bores. The smaller diameter wells are often preferred because they can be drilled more quickly and with less expense than larger diameter well bores.

In the prior art, a variety of pumps are known and are referred to as bladder pumps. Bladder pumps generally comprise a pump housing and a flexible bladder situated in the pump housing, separating the pump housing into an outer chamber and an inner chamber. These conventional bladder pumps rely on the pressure created by the height of a liquid to force liquid into the inner chamber. Air or hydraulic fluid is forced into the outer chamber to collapse the bladder and force the liquid out of the bladder pump. Accordingly, conventional bladder pumps must be positioned below the layer of liquid hydrocarbons and within the ground water when used in a well bore to pump liquid hydrocarbons to the surface. Again, because these bladder pumps must be positioned within the ground water, the liquid hydrocarbons often corrode the outer surface of the bladder pumps. Further, because the bladder pumps are located within the ground water and are connected by a flexible coiled tube to the skimming vessel above, the spring force of the coiled tube tends to pull the skimming vessel downward and below the water line. As a result, ground water can flow into the vessel and mix with the liquid hydrocarbons being pumped to the surface.

After a significant portion of liquid hydrocarbons are removed from the well bore, the layer of liquid hydrocarbons becomes thinner and further measures must be taken to remove the liquid hydrocarbons. It is necessary to pump large quantities of ground water and create a cone of depression within the well bore to remove the remaining liquid hydrocarbons. Conventionally, to create a cone of depression, a larger diameter (about 6 inches) well bore must be drilled and a submersible pump with a bottom intake is positioned within the ground water. The skimming vessel is placed near the center of the cone of depression to collect the remaining liquid hydrocarbons. These submersible bottom intake pumps are normally operated by compressed air or hydraulic fluid pressure. Accordingly, the well bore above the ground water level is occupied by an air or hydraulic fluid input line and a ground water output line. Therefore, there is very little space in the well bore for a separate pump to recover the liquid hydrocarbons gathered by the skimming vessel and the lines that normally accompany such a pump.

Another problem with conventional extraction systems wherein a cone of depression is created occurs when the submersible pump removes ground water from the well bore too rapidly and the level of liquid hydrocarbons drops to the point of intake of the submersible pump. The liquid hydrocarbons are then drawn through the intake of the submersible pump and pumped to the surface with the ground water. The ground water pumped to the surface is then contaminated by the liquid hydrocarbons and the liquid hydrocarbons must be removed from the ground water at surface. Storage of the contaminated ground water and removal of the liquid hydrocarbons from the contaminated ground water at the surface is very costly.

Therefore, there is a need for a relatively small pump which can fit into a 2–4 inch well bore and operate to pump liquid without being submersed therein. Also, there is a need for a pump which can withstand exposure to corrosive liquid hydrocarbons. Further, there is a need for an extraction pump system which removes a minimum of ground water with the liquid hydrocarbons. There is also a need for an extraction pump system which separately pumps ground water to create a cone of depression and which separately pumps liquid hydrocarbons.

SUMMARY OF THE INVENTION

The bladder pump of the present invention generally comprises a flexible inner tube or bladder having a substantial elastic rebound surrounded by a pump housing. The inner tube defines an inner chamber having an inlet opening and an outlet opening. The pump housing forms a space between the pump housing and the inner tube, thereby defining an outer chamber for confining a pump fluid, either pneumatic or hydraulic. The bladder pump permits liquid flow unidirectionally through the inlet opening of the inner tube into the inner chamber and permits liquid flow unidirectionally through the outlet opening of the inner tube from the inner chamber. Controls associated with bladder pumps allow pump fluid into the outer chamber having a pressure sufficient to collapse the inner tube thereby discharging liquid from the inner chamber through the outlet opening. Alternately, the associated controls release the pressurized pump fluid from the outer chamber, thereby allowing the inner tube to rebound to a full configuration and draw liquid into the inner chamber through the inlet opening. The elastic rebound of the inner tube is sufficient to create a vacuum in the tube of at least 5 feet of water. In other words, the pump can pull water from a depth of greater than 5 feet. The bladder pump, by repeatedly allowing pump fluid into the outer chamber and sequentially releasing the pump fluid from the outer chamber, produces a flow of liquid.

More particularly, the bladder pump of the present invention comprises a flexible pump housing. Because the inner tube and the bladder pump housing are then both flexible, the pump can be coiled and positioned in a relatively small space. Even more particularly, the inner tube of the pump comprises neoprene. Because neoprene is relatively chemical resistant, the pump can be used to extract relatively corrosive liquid hydrocarbons from ground water.

In one extraction pump system of the present invention the bladder pump is suspended in the bore to a position above the liquid hydrocarbons, and the inlet opening is connected to a skimmer floating in the ground water and overlying layer of liquid hydrocarbons, so that the pump can draw the liquid hydrocarbons from the well bore and then discharge the liquid hydrocarbons towards the ground surface.

The extraction pump system of the present invention is particularly effective in the swift and immediate extraction of liquid hydrocarbons from ground water. Because the pump of the present invention is relatively small, the well bore can have a relatively small diameter and can be drilled very quickly. Further, because the elastic rebound of the inner tube of the pump draws the liquid hydrocarbons into the inner chamber of the pump, the pump can be suspended above the liquid hydrocarbons in the well bore. Accordingly, the outer surface of the pump is not exposed to corrosive liquid hydrocarbons and the likelihood of ground water being pumped to the surface is reduced.

Another extraction pump system of the present invention comprises an additional pneumatic or hydraulic pump positioned within the ground water and below the liquid hydrocarbons for removing ground water from the well bore to create a cone of depression therein. The extraction pump system simultaneously conducts pneumatic or hydraulic pump fluid to the pump positioned within the ground water and the bladder pump suspended above the liquid hydrocarbons, and simultaneously conducts the pump fluid from both of those pumps. Because the bladder pump of the present invention suspended above the liquid hydrocarbons is relatively small, the bladder pump can easily be suspended within a well bore despite the presence of other pieces of equipment in the well bore. Further, because the pump fluid is conducted to and from both pumps simultaneously, separate lines conducting pump fluid to and from each of the pumps is not necessary and the well bore is less crowded.

Another extraction pump system of the present invention comprises a first electrically powered pump positioned within the ground water and below the liquid hydrocarbons in a well casing for removing ground water to create a cone of depression. A portion of the ground water pumped by the first pump is diverted to a bladder pump of the present invention to drive the bladder pump so the bladder pump can remove liquid hydrocarbons from the well casing. In addition, magnetic sensors associated with a skimmer for the bladder pump serve as a level indicator to control the electric pump and thereby regulate the cone of depression.

Therefore, an object of the present invention is to provide an improved pump.

Another object of the present invention is to provide a pump for the recovery of liquid hydrocarbons from ground water.

Another object of the present invention is to provide a pump which occupies a minimum space.

Another object of the present invention is to provide a pump which is operable without being submersed in liquid.

Another object of the present invention is to provide a pump for the recovery of corrosive liquid hydrocarbons from ground water.

Another object of the present invention is to provide an improved extraction pump system for the recovery of liquid hydrocarbons from ground water.

A further object of the present invention is to provide an extraction pump system which is effective for the swift and efficient removal of liquid hydrocarbons from ground water.

Other objects, features, and advantages of the present invention will become apparent from reading the following specification in conjunction with the accompanying drawings.

BRIEF DESCRIPTION OF THE DRAWINGS

FIG. 6 is a top plan view of a skimming vessel for use in open bodies of water with preferred embodiments of extraction pump systems of the present invention.

FIG. 7 is a side elevation view of a skimming vessel for use in open bodies of water with preferred embodiments of extraction pump systems of the present invention.

DETAILED DESCRIPTION OF THE PREFERRED EMBODIMENTS

Figure 1:
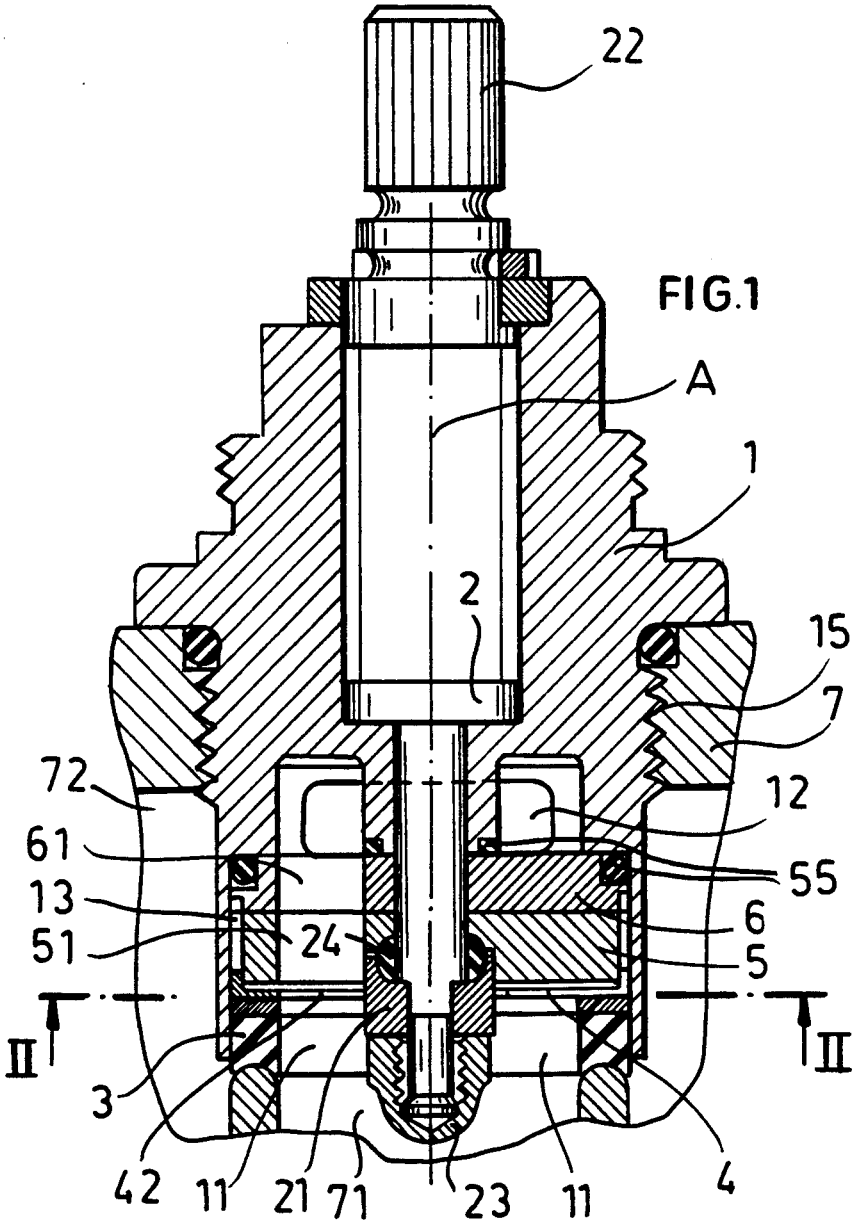
FIG. 1 is a sectioned side elevation view of a preferred embodiment of the bladder pump of the present invention, illustrating the inner tube of the bladder pump in the full configuration.
Figure 2:
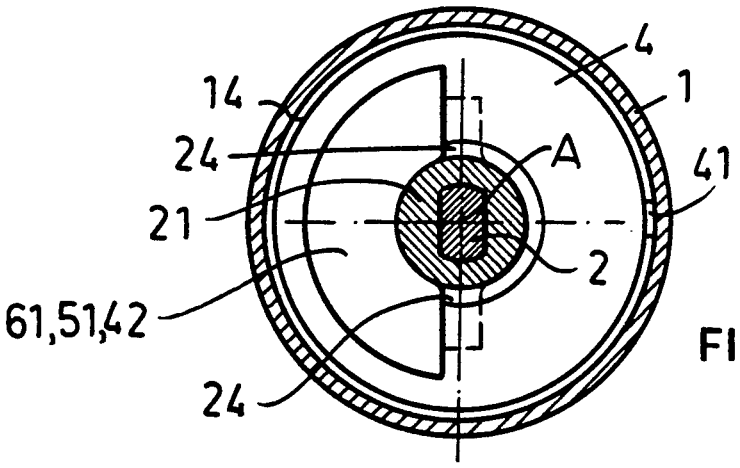
FIG. 2 is a side elevation view shown in FIG. 1, illustrating the inner tube of the bladder pump in the collapsed configuration.

Turning to FIGS. 1 and 2, the bladder pump 10 is shown comprising an intake head 12, a discharge head 85, an inner tube or bladder 50, a flexible outer tube or housing 75, intake check valve 130, and discharge check valve 160. FIG. 1 shows the bladder pump with the inner tube 50 expanded at the beginning of a discharge, and FIG. 2 shows the inner tube 50 collapsed at the beginning of an intake.

The intake head 12 of the bladder pump 10 includes a cap 14. The cap 14 has a hexagonal end 16 and a more narrow threaded shaft 18 extending from the end. A cylindrical passageway 20 extends through the cap 14 from the hexagonal end 16 through the threaded shaft to the end 22 of the threaded shaft opposite the hexagonal end. An o-ring 24 fits into a channel in the end 22 of the threaded shaft 18 surrounding the passageway 20, and a washer 25 fits against the end 22 of the threaded shaft 18 and the o-ring. The intake head 12 also comprises a shaft 27 having a flared end 30 and a barbed end 32 separated by a rib 34 which extends outwardly from the shaft. The flared end 30 of the shaft 27 fits against the washer 25 and the shaft extends from the washer in alignment with the passageway 20 in the cap 14. A connector 36 has a threaded end 38 which screws onto the threaded shaft 18 of the cap 14 and a tapered end 40 which extends from the threaded end and fits over the flared end 30 of the shaft 27, thereby connecting the cap 14 to the shaft 27. The intake head 12 also includes an elongated intake conduit 42 which has a barbed end 44 and a threaded end 45. The intake conduit 42 fits through the shaft 27 and the passageway 20 in the cap 14 of the intake head 12, so that the threaded end 45 of the intake conduit extends from the hexagonal end 16 of the cap 14 and the barbed end 44 extends from the barbed end 32 of the shaft 27.

The discharge head 85 includes a cap 87. The cap 87 has a hexagonal end 89, and a threaded shaft 92 which extends from the hexagonal end to a tapered end 94. A discharge passage 96 runs through the center of the cap 87 from the hexagonal end 89 to the tapered end 94 of the threaded shaft 92. A pump fluid passage 99 runs through the cap 87 alongside the discharge passage 96 from the hexagonal end 89 to the tapered end 94 of the threaded shaft 92. The discharge head 85 also comprises a shaft 102 having a flared end 104 and a barbed end 106 separated by an outwardly extending rib 108. The flared end 104 of the shaft 102 fits against the tapered end 94 of the threaded shaft 92, and the shaft 102 extends from the tapered end of the threaded shaft in alignment with the discharge passage 96. A connector 110 has a threaded portion 112 which screws onto the threaded shaft 92 and a tapered portion 114 which extends from the threaded portion and over the flared end 104 of the shaft 102, thereby connecting the cap 87 to the flared end of the shaft 102. An elongated discharge conduit 118 has a threaded end 120 which screws into threads in the discharge passageway at the tapered end 94 of the cap 87. The discharge conduit 118 extends from the threaded end 120 to a barbed end 122 which extends from the barbed end of the shaft 102. The inner tube 50 has an inner chamber 51 with an intake opening 52 at one end and a discharge opening 54 at the other end. The barbed end 44 of the intake conduit 42 fits tightly through the intake opening 52 of the inner tube 50 and the barbs in the barbed end hold the intake conduit tightly within the inner tube. Likewise, the barbed end 122 of the discharge conduit 118 fits tightly in the discharge opening 54 of the inner tube 50.

The inner tube 50 preferably comprises a reinforced synthetic rubber hose having substantial elastic rebound such as a Parker Push-Lok hose manufactured by Parker Hannifin Corporation of Wickliffe, Ohio. In a particular embodiment of the pump 10, the inner tube 50 comprises a Parker Push-Lok series 801 hose. Although the pump 10 is not limited to a particular size, the inner tube 50 in the aforementioned embodiment comprises a Parker Push-Lok 801-6 hose having an inside diameter of $\frac{3}{8}$ inches and an outside diameter of 0.62 inches for applications that require a very small pump. Such applications are discussed in detail hereinafter. The inner tube 50 preferably comprises a material, such as neoprene, which resists corrosion by liquid hydrocarbons. One such inner tube that comprises a Parker Push-Lok hose comprising a rubber material designated as Buna-N rubber by Parker Hannifin Corporation is preferred. The inner tube 50 must have sufficient elastic rebound to draw a vacuum of at least 5 feet of water when the inner tube is released from a collapsed state.

A flexible outer tube 75 fits over the inner tube 50, and one end 77 of the outer tube fits tightly over the barbed end 32 of the shaft 27 of the intake head 12. The barbs on the barbed end 32 of the shaft 27 hold the intake head 12 firmly to the end 77 of the outer tube 75. A stop 79 fits against the rib 34 of the shaft 27 and extends over the end 77 of the outer tube 75. Likewise, the other end 125 of the outer tube 75 fits tightly over the barbed end 106 of the shaft 102. The outer tube 75 is spaced from the inner tube 50 so as to form an outer chamber 80. The outer tube 75 also preferably comprises a reinforced synthetic rubber hose such as a Parker Push-Lok hose. For example, the outer tube 75 may comprise a Parker Push-Lok series 801 hose and in a particular embodiment comprises a Parker Push-Lok 801-12 hose having an inside diameter of ¾ inches and an outside diameter of 1.03 inches. The outer tube must be sufficiently strong to withstand the pressure required in the chamber 80 to collapse the inner tube 50 and force its contents to the well head. It is also desirable that the outer tube 75 be flexible so that it may be coiled.

The inlet check valve 130 is located below the intake head 12. The inlet check valve 130 includes an entrance shaft 132 and an exit shaft 134 connected by a threaded coupling 136 so as to form a valve chamber 138 between the entrance shaft and the exit shaft. The inlet check valve 130 also includes a ball 140 within the valve chamber 138. A passage 142 through the inlet shaft 132 expands outwardly toward the valve chamber 138 and forms a valve seat 144. The inward facing end 146 of the exit shaft 134 has notches 148 adjacent the passage through the exit shaft to allow flow around Ball 140 and through the check valve 130. The inner passage of the exit shaft 134 of the check valve 130 is threaded and screws onto the threaded end 45 of the intake conduit 42. An intake pipe 151 screws into the entrance shaft of the check valve 130.

A discharge check valve 160 identical to the intake check valve 130 is connected to the discharge passage 96 in the discharge head 85 by a hollow shaft 162. A discharge pipe 225 screws into the exit shaft of the discharge check valve 160. It should be understood that check valves other than the type shown in FIGS. 1 and 2 may be used to construct the pump of the present invention.

A pump fluid conduit 169 extends from the pump fluid passage 99 in the discharge head 85 and connects the pump fluid passage with a source of pump fluid such as compressed air or hydraulic fluid.

Other illustrated features of the discharge portion of the pump 10, and their correspondence to analogous features of the intake portion of the pump, are: stop 128, corresponding to 79; exit shaft 135 of valve 160, corresponding to 134; ball 141 corresponding to 140; valve seat 145, corresponding to 144; notches 147 in outer facing end of valve 160, corresponding to 148.

Figure 3:
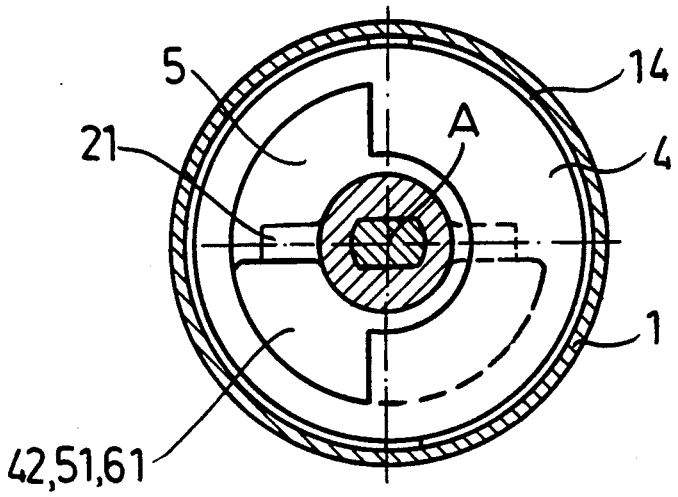
FIG. 3 is a sectioned side elevation view showing a preferred embodiment of an extraction pump system of the present invention, illustrating a bladder pump and a skimming vessel for removing liquid hydrocarbons from a well bore.

Turning to FIG. 3, an extraction pump system 190 is shown for a well 200. The well 200 comprises a concrete vault 210 positioned at the ground surface 212 surrounding a control compartment 215. The well 200 also comprises a perforated well casing 218 which extends below the concrete vault 210 into a aquifer 207 containing ground water 205 and a floating layer of contaminating liquid hydrocarbons 202. The bladder pump 10 is suspended in the well casing 218 for removing the layer of contaminating liquid hydrocarbons 202 from the ground water 205 in the aquifer 207.

The pump 10 is suspended in the well casing 218 to a position above the layer of liquid hydrocarbons 202 with a cable 220 fixed at 222 within the control compartment 215. The pump fluid conduit 169 connects the pump fluid passage 99 in the bladder pump 10 to a controller 223 (shown in FIG. 10 and described in detail hereinbelow) which connects the pump fluid conduit 169 to a source of compressed air available at an input pipe 224. The compressed air is used to drive the bladder pump 10. It should also be understood that the pump bladder 10 can be driven with compressed gas other than air or with hydraulic fluid pressure. Discharge pipe 225 is connected to the bladder pump 10 for conducting the liquid hydrocarbons removed by the pump to the ground surface 212.

The extraction pump system 190 also comprises a floating hydrocarbon skimmer 230. The skimmer 230, shown in detail FIG. 4, comprises an outer container 232 consisting of a tube 234 with an enclosed top 236 and an enclosed bottom 239. The tube 234 includes slots 241 spaced along the length of the tube to allow in flow of liquid hydrocarbons and ground water.

A skimming inner vessel 243 fits within the container 232. The inner vessel 243 comprises a block 244 having an upper edge 246 defining a top opening 247 of a vertical trough 248. A narrow pipe 250 fits through and is attached to the top 236 of the container 232 and extends through the opening 247 of the inner vessel 243 into the vertical trough 248. As shown in FIG. 3, the liquid hydrocarbons skimmer 230 fits within the well casing 218 and floats in the liquid hydrocarbons 202 and the ground water 205. A coiled tube 255 connects the end of the intake pipe 151 of the bladder pump 10 to the tube 250 extending into the skimming vessel 243. The coiled tube 255 preferably comprises a flexible plastic material so that the tube 255 can expand or contract as the hydrocarbon skimmer moves up and down within the well casing 218.

The skimmer container 232 including the pipe 250 and the inner vessel 243 of the hydrocarbon skimmer 230 preferably comprise a material having a specific gravity slightly less than that of water so that the hydrocarbon skimmer is buoyant in the ground water 205 in the aquifer 207. More specifically, the hydrocarbon skimmer 230 preferably comprises a material having a specific gravity of about 0.96. The combination of the container 232 and the pipe 250 has a greater than neutral buoyancy so that the top 236 of the container 232 is above the liquid hydrocarbon layer 202. The coiled tube 255 acts like a spring and tends to pull the skimmer container 232 above the liquid hydrocarbon layer 202. This is particularly apparent when the level of the ground water 207 in the aquifer 207 drops. The inner vessel 243, however, floats freely within the skimmer housing and is not affected by the pull of the coiled tube 255. Because the inner vessel 243 also has a specific gravity less than water providing a greater than neutral buoyancy, the upper edge 246 of the inner vessel 243 floats within the layer of liquid hydrocarbons 202 or at the interface between the layer of liquid hydrocarbons and the ground water 205. As the upper edge 246 of the inner vessel floats within the layer of hydrocarbons 202, the liquid hydrocarbons flow over the upper edge and into the vertical trough 248 of the inner vessel 243.

The narrow tube 250 preferably extends from the top 236 of the housing to a point slightly more than halfway along the length of the skimming container 232. Also, the length of the inner vessel 243 is preferably slightly more than one half the length of the skimmer container 232 so that the inner vessel can oscillate along the full length of the tube 250 within the skimmer container.

Figure 4:
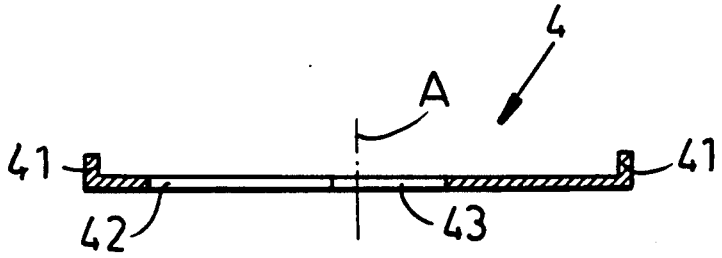
FIG. 4 is an enlarged sectioned side elevation view of a skimming vessel for use in well bores with preferred embodiments of extraction pump systems of the present invention.

The extraction system 190 in FIG. 3 also comprises a level sensor tube 260 which extends from the controller 223, down the well casing 218, through the top 236 of the skimmer housing 232 and into the inner vessel 243 to a lower end 264 adjacent the lower end of the tube 250 as shown in FIG. 4. Returning to FIG. 3, an input pipe 267 is shown connecting the controller 223 to a source of constant compressed air for operation of the controller as will be described in further detail hereinafter.

To remove the liquid hydrocarbon layer 202 from the aquifer 207, repeated pulses of compressed air produced by conventional means well known to those skilled in the art travel through an input line 224, the controller 223, the pump fluid conduit 169, the pump fluid passage 99, the shaft 102, and into the outer chamber 80 between the inner tube 50 and the outer tube 75. Each pulse of compressed air has a pressure sufficient to collapse the inner tube 50 from the full configuration shown in FIG. 1 to the collapsed configuration shown in FIG. 2. After each pulse of compressed air, the compressed air is allowed to escape from the outer chamber 80 back through the pump fluid passage 99 and the pump fluid conduit 169 and the pressure within the outer chamber 80 returns to atmospheric pressure. With the release of the pressure from the compressed air, the inner tube 50, due to the elastic rebound of the inner tube, snaps back from the collapsed configuration to the full configuration. As previously described, the inner tube has sufficient elastic rebound to pull water at least 5 feet.

When the first pulse of compressed air reaches the outer chamber 80 of bladder pump 10, the inner tube 50 collapses from the full configuration shown in FIG. 1 to the collapsed configuration shown in FIG. 2. As the inner tube collapses, air within the inner chamber 51 is forced outwardly towards the check valves 130 and 160. The outwardly moving air forces the ball 140 within the valve chamber 138 of the intake check valve 130 downward against the valve seat 144, thereby blocking flow of the air through the intake shaft 151, and simultaneously forces ball 141 in the discharge check valve 160 upwardly against notched end 147 of exit shaft 135 so that the air within the inner chamber can escape through the discharge conduit 118, through the discharge passage 96, through the discharge check valve 160 around the ball 141, and through the discharge pipe 225 to the surface 212. When the first pulse of compressed air is released, the inner tube 50 snaps back to the full configuration, thereby creating a vacuum of at least 5 feet of water. The vacuum pulls the ball 141 in the discharge check valve 160 downward against valve seat 145 and blocks flow into the inner chamber 51 through the discharge passage 96, and simultaneously pulls the ball 140 in the intake check valve 130 upwardly against the notched end 146 of the exit shaft 134 and pulls the liquid hydrocarbons within the inner vessel 243 through the tube 250, the coiled tube 255, through the intake pipe 151, into the valve chamber 138, around the ball 140, through the notches 148, through the intake conduit 42, and into the inner chamber 51. The second pulse of air through the pump fluid conduit 169 enters the outer chamber 80 and again collapses the inner tube 50, this time forcing the liquid hydrocarbons, previously drawn into the inner chamber 51, out of the inner chamber through the discharge conduit 118, through the discharge passage 96, through the discharge check valve 160, and through the discharge pipe 225 to the surface 212. The ball 140 in the discharge check valve 130 prevents the liquid hydrocarbons from flowing back through the intake check valve 130 and into the skimming inner vessel 243. Repeated pulses of compressed air cause the inner tube 50 to oscillate between the full configuration and the collapsed configuration, thus creating a flow of liquid hydrocarbons from the skimming inner vessel 243 through the pump 10 to the surface 212.

Figure 10:
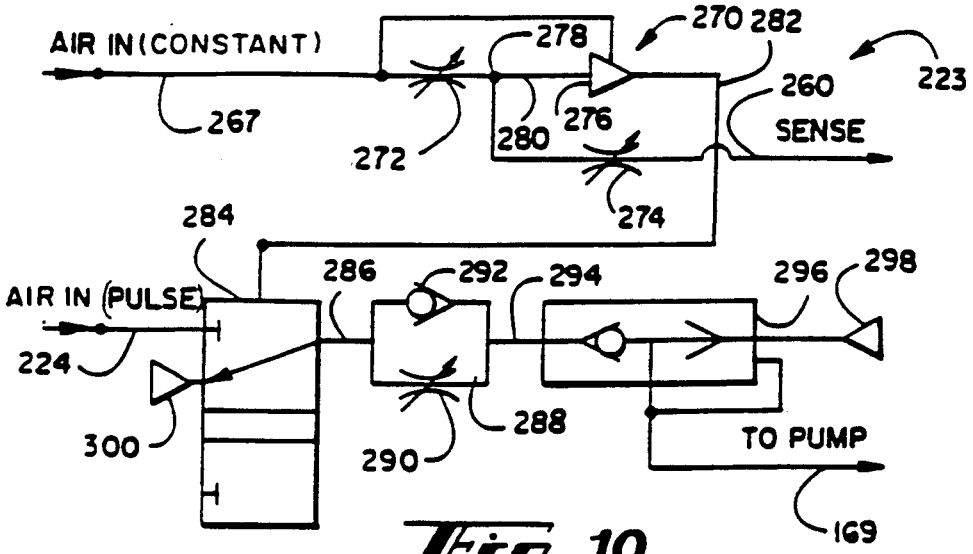
FIG. 10 is a schematic diagram showing the air logic used to control the supply of the timed air pulses to the preferred embodiments of the extraction pump systems of the present invention.

Turning to FIG. 10, there is shown a schematic diagram of a controller 223 which controls the operation of the bladder pump 10. The controller 223 includes a sensing circuit 270 comprising restrictors 272 and 274 and an operational amplifier 276. The sensing circuit 270 has a source of constant compressed air on input 267. The compressed air passes through restrictor 272 to the input of operational amplifier 276 and to the output restrictor 274. The output restrictor is connected to the level sensor tube 260 which extends into the skimming inner vessel 243. As long as the liquid in the inner vessel 243 has not risen to the lower end 264 of the level sensor tube 260, insufficient back pressure exists in the level sensor tube and at node 278 to turn on the operational amplifier 276. Once the liquid in the skimming inner vessel 243 rises to a level of about 2 to 3 inches above the lower end 264 of the level sensor tube 260, sufficient back pressure is created in the level sensor tube so that enough air is diverted at node 278 from the level sensor tube to the input 280 of the operational amplifier 276 to turn on the operational amplifier.

When the operational amplifier 276 turns on, producing air pressure at its output 282, it drives shuttle valve 284 to its "on" condition which connects input pipe 224 to output 286. Input 224 of shuttle valve 284 receives a timed pulse of air on line 224, which pulse is formed by conventional circuitry (not shown). Particularly, the air pulse on line 224 has an on time more than sufficient to collapse the inner tube 50 of the elastic rebound pump 10 and an off time sufficient to allow the inner tube to return to the full configuration.

The air pulse on input line 224 is connected by shuttle valve 284 to output 286 and then to flow control valve 288, which has a restricted forward path through restrictor 290 and an unrestricted return path through check valve 292. The air pulse at output 294 is then connected through quick exhaust valve 296 to the pump fluid conduit 169. Once the air pulse ends, quick exhaust valve 296 reverses and the pump fluid conduit 169 is connected to exhaust port 298, thereby rapidly relieving the pressure in the outer chamber 80 of the elastic rebound pump 10. If during the off time (unpressurized time) the level of liquid in the skimming inner vessel 243 drops below two to three inches above the lower end 264 of the level sensor tube 260, the sense circuit 270 turns off thereby causing shuttle valve 284 to return to its exhaust state with output line 286 connected to exhaust port 300. Consequently, any residual pressure in the lines of the circuitry is relieved through check valve 292 of the return path of flow control valve 288 and through the shuttle valve 284 to the exhaust port 300. If on the other hand, the liquid in the skimming inner vessel 243 had not dropped below 2 or 3 inches above the lower end 264 of the level sensor tube 260 during the off time of the air pulse on line 224, the sensing circuit would have stayed on, thereby keeping the shuttle valve 284 in its on position so that when the next timed air pulse appeared at input 224, the elastic rebound pump 10 would cycle again.

Figure 11:
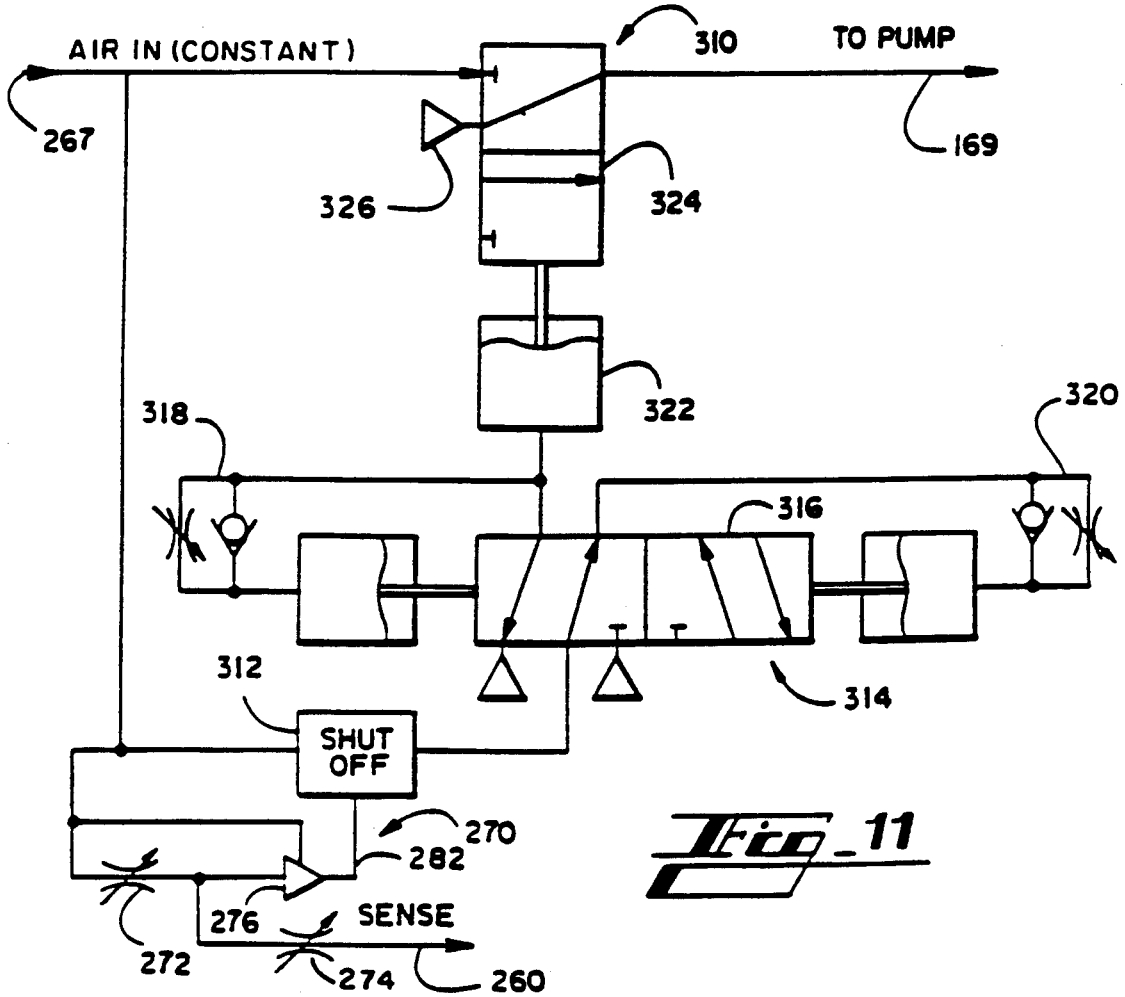
FIG. 11 is a schematic diagram showing the air logic used to produce and control the supply of timed air pulses to the preferred embodiments of the extraction pump systems of the present invention.
Figure 1:
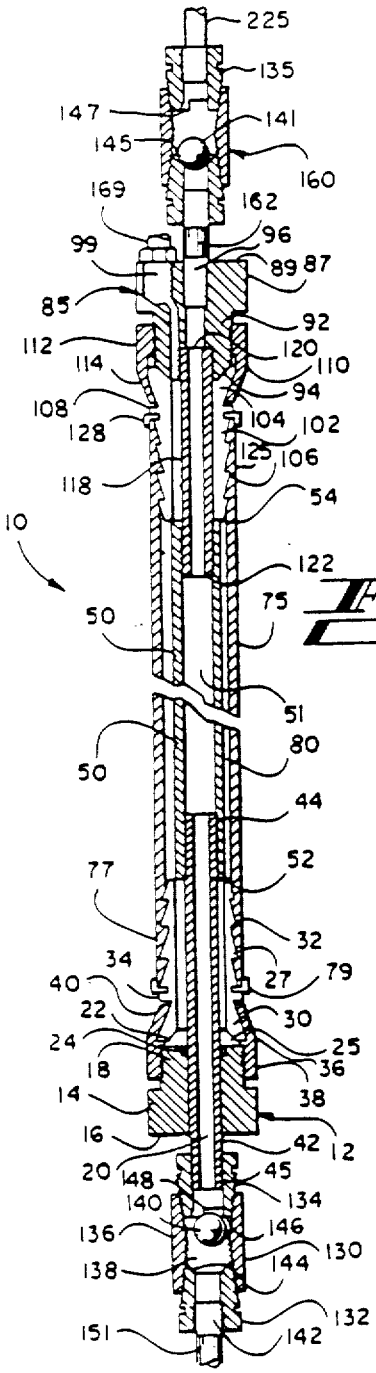
Figure 2:
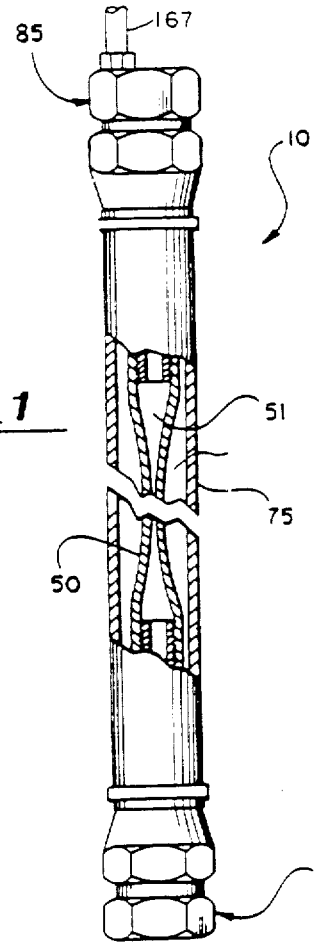
Figure 3:
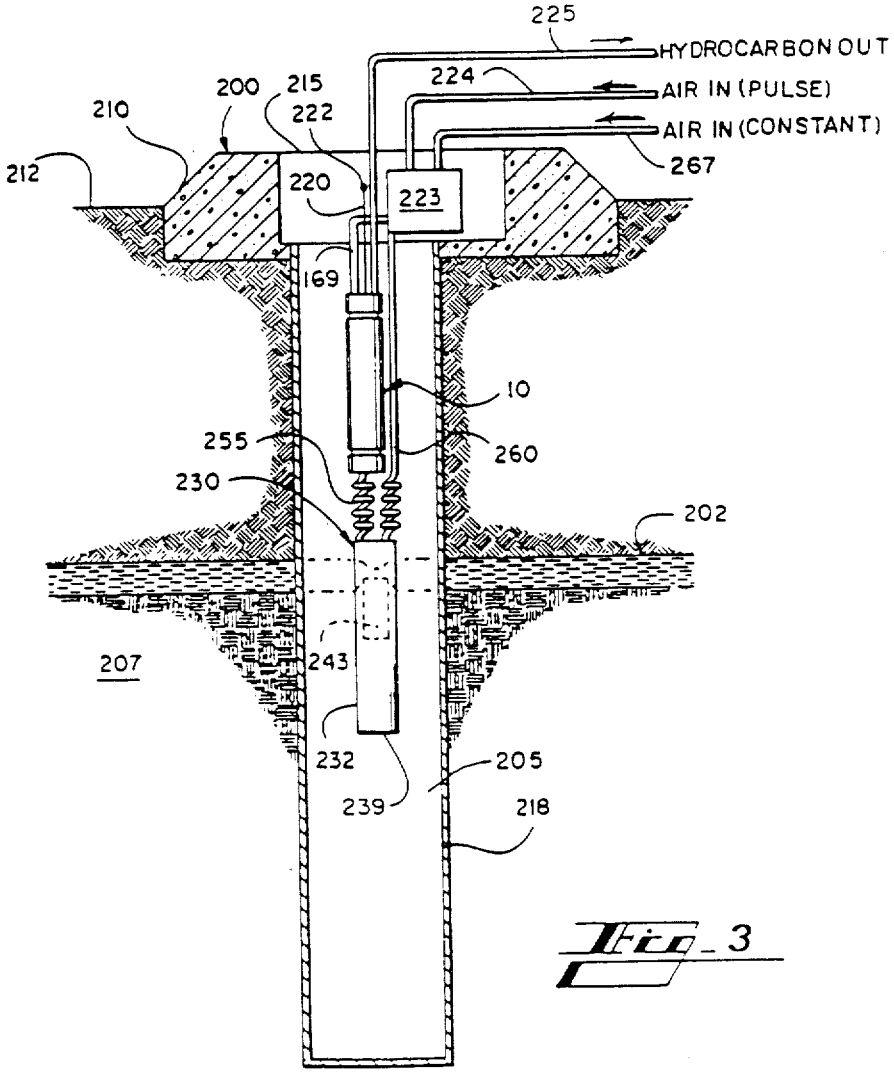
Figure 4:
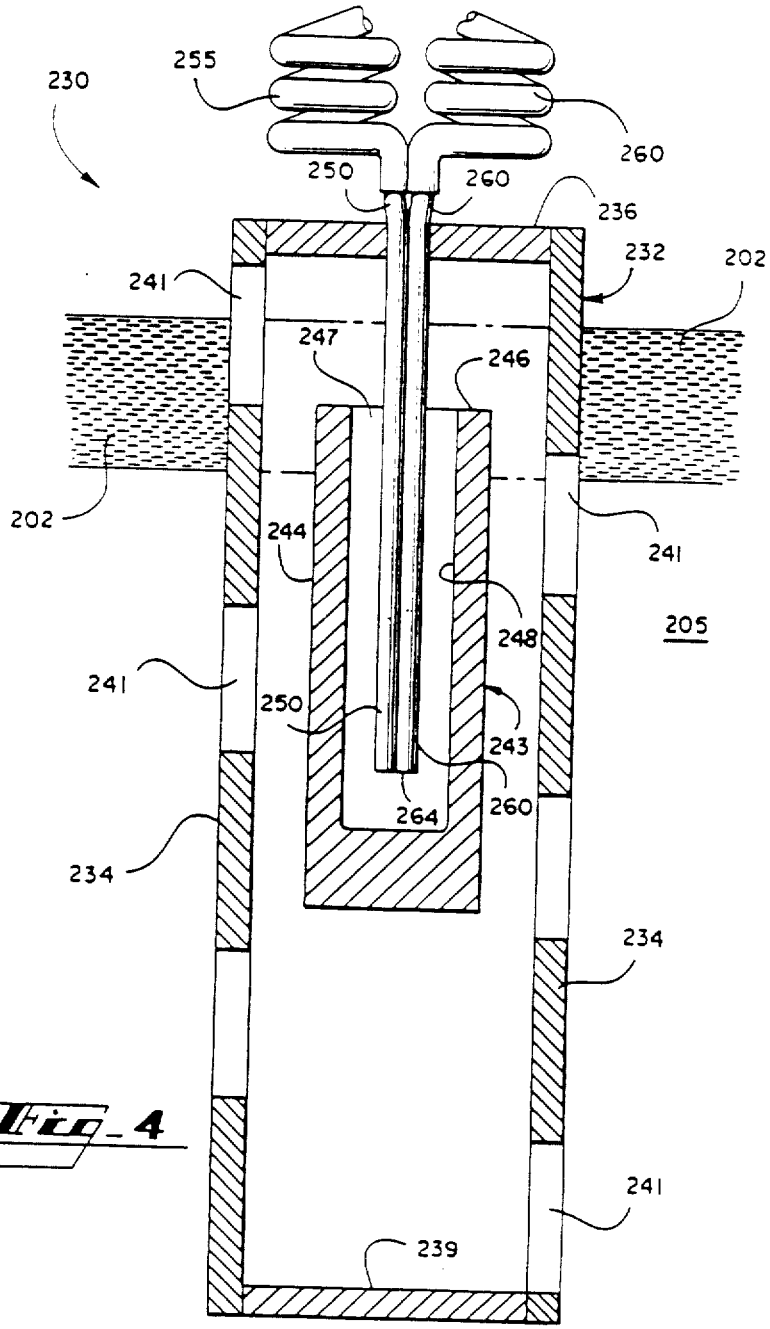
Figure 5:
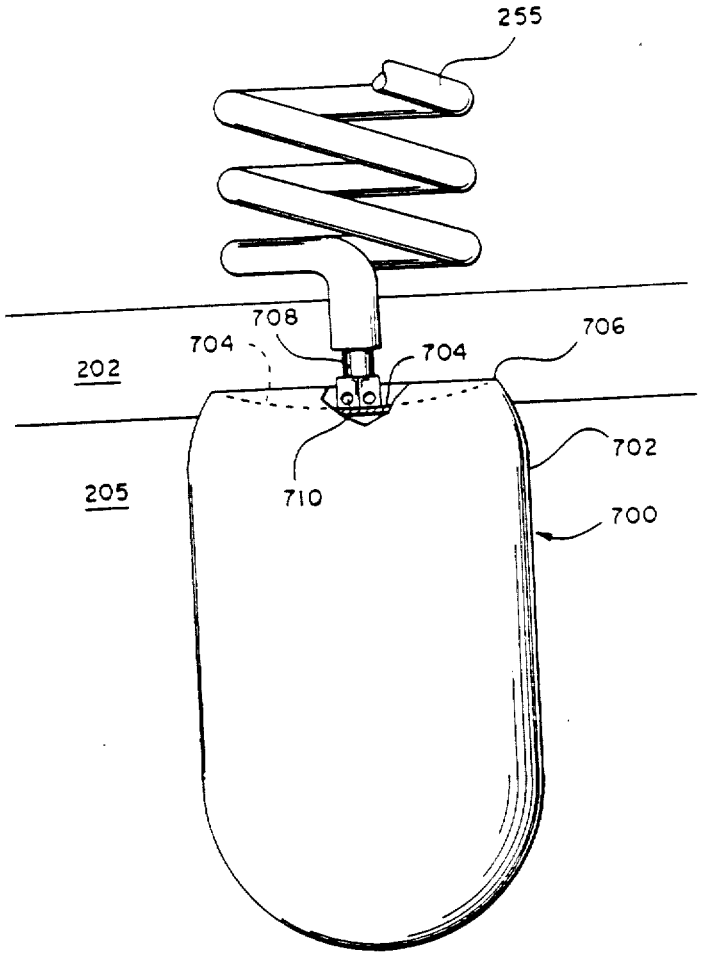
Figure 8:
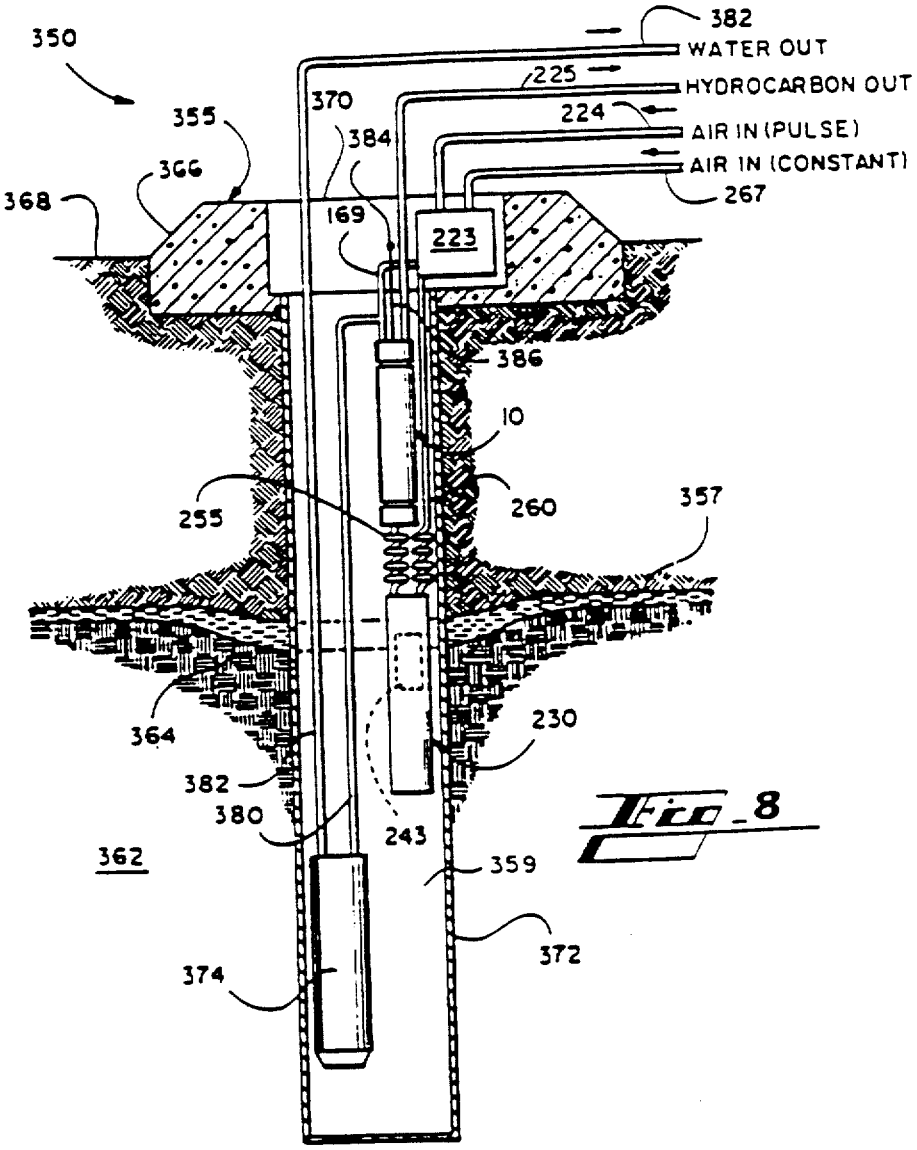
Figure 9:
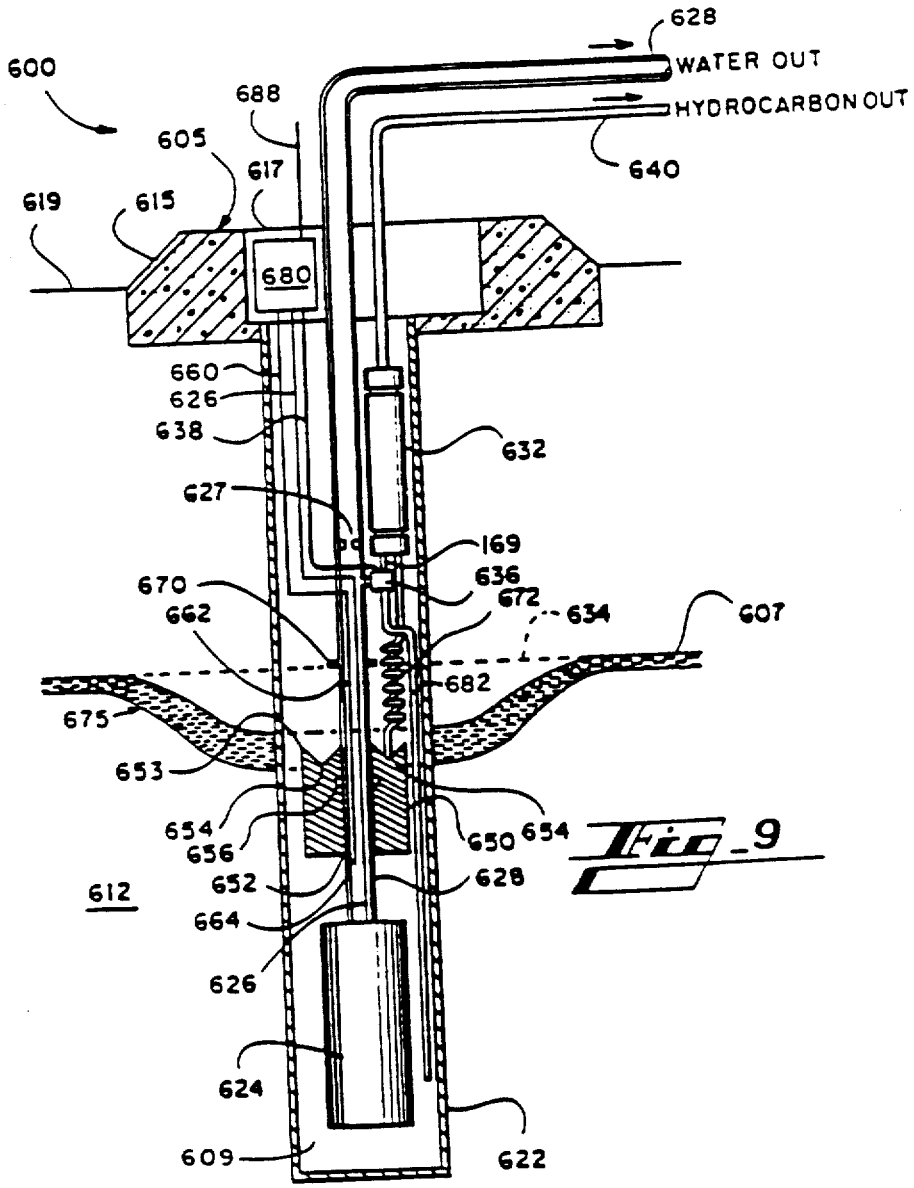
Figure 10:
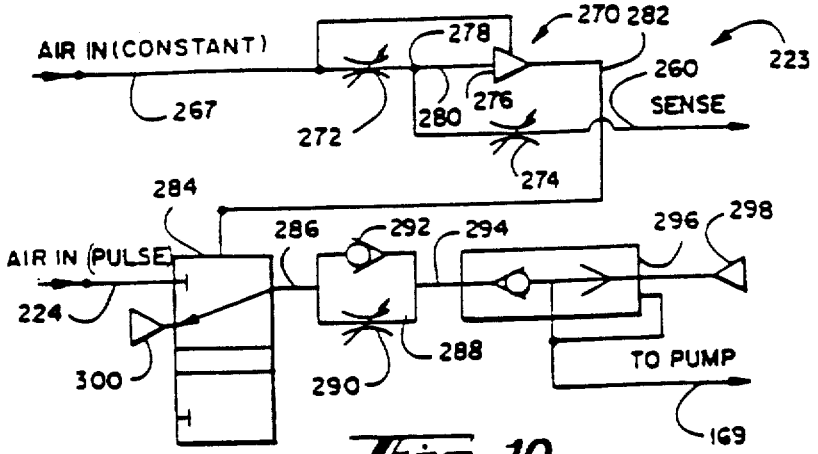
Figure 11:
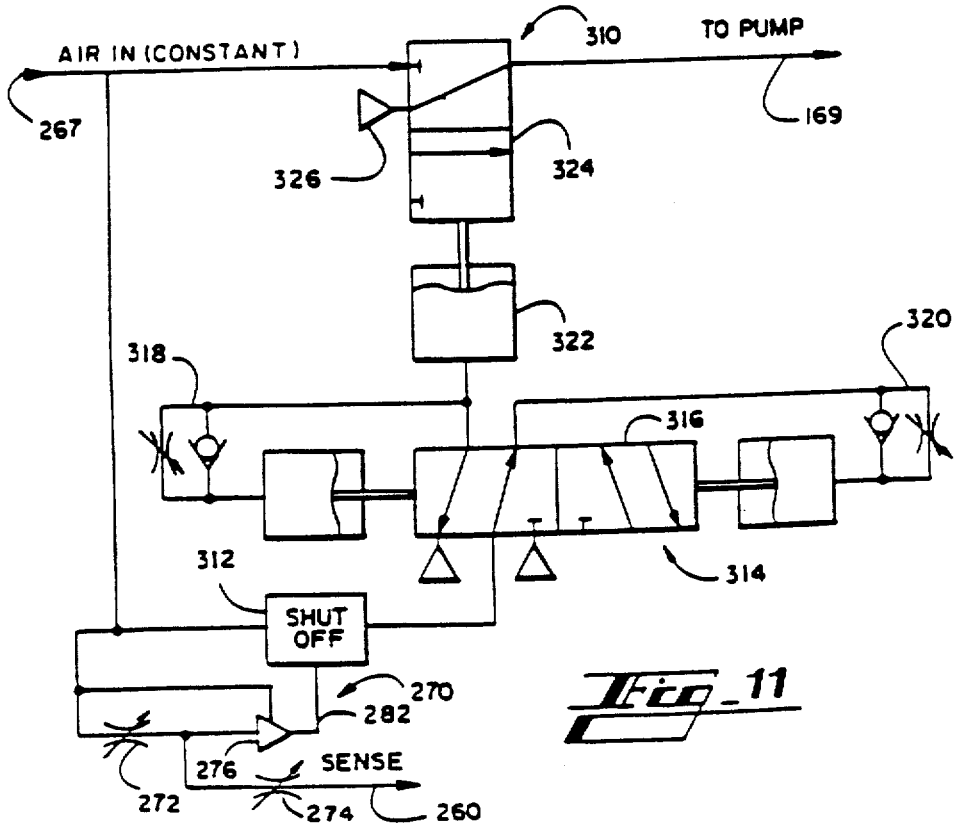

In an alternative embodiment of the present invention, additional circuitry can be provided in controller 223 which will produce a timed air pulse for operation of the elastic rebound pump 10. Turning to FIG. 11 there is shown an alternative control circuit 310 to replace controller 223. The alternative circuit 310 receives constant air pressure from a compressor on line 267. The circuit 310 includes a sensing circuit 270 which operates as previously described. The sensing circuit controls a shut-off valve 312 which connects the compressed air on line 267 to a timing circuit 314. The timing circuit 314 controls shuttle valve 316 which includes an on-time restrictor 318 and an off-time restrictor 320. The shuttle valve 316 alternatively provides air to and said exhaust air from control cylinder 322, which in turn controls shuttle valve 324. Shuttle valve 324 alternatively connects the pump fluid conduit 169 to the compressed air on input 267 or the exhaust port 326. The timing circuitry 310 is described in greater detail in U.S. Pat. No. 3,647,319.

The bladder pump 10 is particularly advantageous when used in a relatively small diameter well such as a two to four inch diameter well. As discussed hereinabove, the bladder pump 10 can be constructed so that the outer tube 75 has a diameter of about one inch. Accordingly, the pump 10 can easily be suspended in a well having a diameter as small as 2 inches. In addition, the bladder pump 10 is not damaged if operated "dry". In other words, the bladder pump 10 is not damaged if the bladder pump empties the liquid hydrocarbons from the skimming inner vessel 243 and draws air. Accordingly, a device which monitors the level of liquid hydrocarbons within the skimming inner vessel 243 so that the bladder pump can be shut off when the skimming vessel is substantially empty is not necessary; however, such a device is normally preferred to quantify the amount of liquid hydrocarbons removed from the well.

Figure 5:
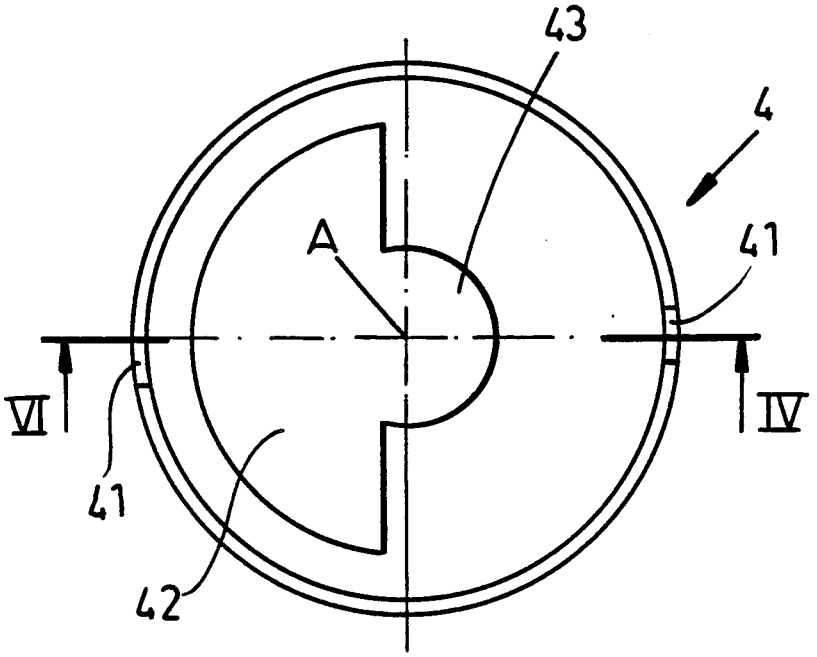
FIG. 5 is a side elevation view showing an alternative skimming vessel for use in well bores with preferred embodiments of extraction pump systems of the present invention.

An alternative skimmer 700 for the extraction pump system 190 is shown in FIG. 5. The skimmer 700 consists of a cylindrical slug 702 which has a top concave surface 704 bounded by a top outer edge 706. A barbed connector 708 with inlet holes 710 is fixed to the center of the concave surface 704 and is attached to coiled tube 255. The ends of the slug 702 are rounded so that the slug can move up and down in the well casing without binding.

The skimmer 700 has a neutral buoyancy so that the top edge 706 is located adjacent the surface of the ground water 205 when left to float free. The spring action of the coiled tube, however, pulls the skimmer up into the liquid hydrocarbon layer until the difference between the buoyed mass and the unbuoyed mass equals the spring force. The small spring force helps assure that the edge 706 of the skimmer 700 is in the liduid hydrocarbon layer 202 and therefore only liquid hydrocarbons flow over the edge onto the concave surface and into the connector inlets.

FIGS. 6 and 7 show an open water skimmer 800 used with the bladder pump 10 in cleaning up open bodies of water. The skimmer 800 comprises a saucer shaped body 802 with a top concave surface 804 surrounded by a top outer edge 806. A connector 812 is provided in the center of the concave surface to connect the skimmer to the bladder pump. A baffle or fence 808 is erected adjacent the edge 806 and surrounds the concave surface 804. The baffle has holes 810 next to the concave surface. The skimmer 800 has a greater than neutral buoyancy so that the edge of the saucer is just above the surface of the water and is located in the layer of floating liquid hydrocarbons. The baffle serves as a wave barrier to exclude waves of water that would swamp the saucer, would be drawn into the connector, and would mix with the hydrocarbons making ultimate separation more difficult.

Figure 8:
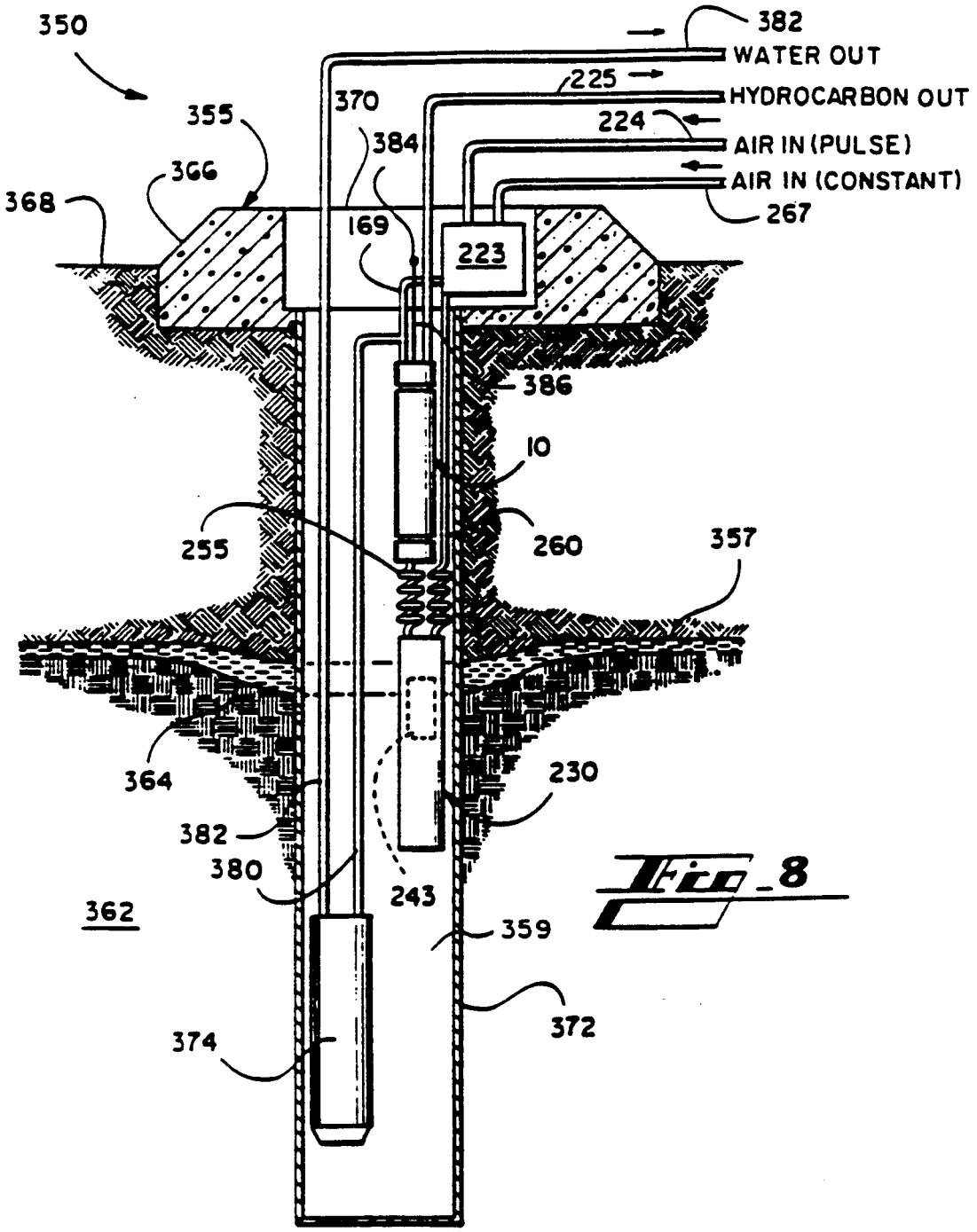
FIG. 8 is a sectioned side elevation view of a preferred embodiment of an extraction pump system of the present invention including a bladder pump and a submersible bottom intake pump for creating a cone of depression.

Turning to FIG. 8, another preferred embodiment of an extraction pump system 350 is shown comprising a larger diameter well 355 with the bladder pump 10 suspended therein for the removal of a layer of liquid hydrocarbons 357 from the ground water 359 in an aquifer 362 by creating a cone of depression 364 in the aquifer. The well 355 comprises a concrete vault 366 surrounding a control compartment 370 at the surface 368. A well casing 372 extends from the control compartment 370 into the aquifer 362 below the surface 368.

A bottom intake submersible pump 374 is suspended in the well casing 372 at a position below the layer of liquid hydrocarbons 357 and within the ground water 359. The use of a bottom intake pneumatic submersible pump to create a cone of depression in an aquifer is well known to those skilled in the art; therefore, the structure of the pump 374 will not be discussed here in detail. However, a pump such as that disclosed in McClean et al. U.S. Pat. No. 3,647,319 incorporated herein by reference, is effective to produce such a cone of depression. An input pipe 380 connects the submersible pump 374 to the pump fluid conduit 169 of the bladder pump 10. A ground water discharge pipe 382 is connected to the top of the submersible pump 374 and extends from the submersible pump to the surface 368.

A liquid hydrocarbon skimmer 230 as described hereinabove floats in the layer of liquid hydrocarbons 357 and the ground water 359 alongside the input pipe 380. The skimmer 230 operates to collect the liquid hydrocarbons 357 as described hereinabove. The bladder pump 10 is suspended from the control compartment 370 at 384 with a cable 386 to a position above the layer of liquid hydrocarbons 357 and the liquid hydrocarbon skimmer 230. The pump fluid conduit 169 of the elastic rebound pump 10 is connected to the controller 223, described hereinabove, which simultaneously provides compressed air pulses to both the submersible pump 374 and the bladder pump 10. The coiled tube 255 connects the bladder pump to the tube 250 extending into the skimming inner vessel 243, and the discharge line 225 extends from the bladder pump to the surface 368 as described hereinabove. In addition, the extraction system 350 includes the level sensor tube 260 which also operates as described hereinabove.

The air pulses from the controller 223 travel through the pump fluid conduit 169 to the bladder pump 10 and through the input pipe 380 to the submersible pump 374, and drive both the bladder pump and the submersible pump simultaneously. Each pulse of air delivered by the input pipe 380 forces water, taken in by the submersible pump 374, out of the well casing 372 through the discharge pipe 382. By removing water from the well casing 372 at a faster rate than the aquifer 362 can replace the water, the cone of depression 364, within the well casing is created. The liquid hydrocarbons 357 flow by gravity towards the center of the cone of depression 364 thereby creating a thicker layer of liquid hydrocarbons at the center of the cone of depression. The liquid hydrocarbons 357 weir over into the skimming inner vessel 243 and are pumped to the surface 368 by the bladder pump 10 as described hereinabove.

Because of the presence of the submersible pump 362 and the pipes associated therewith within the well casing 372, the space in which to suspend the bladder pump 10 is limited. However, because of the small size of the bladder 10, the elastic rebound pump is easily suspended within the well casing 372. Additionally, because the controller provides air pulses to both the bladder pump 10 and the submersible pump 374, an additional controller and input line providing compressed air to the bladder pump is not necessary and the available space within the well casing 372 is conserved.

Figure 9:
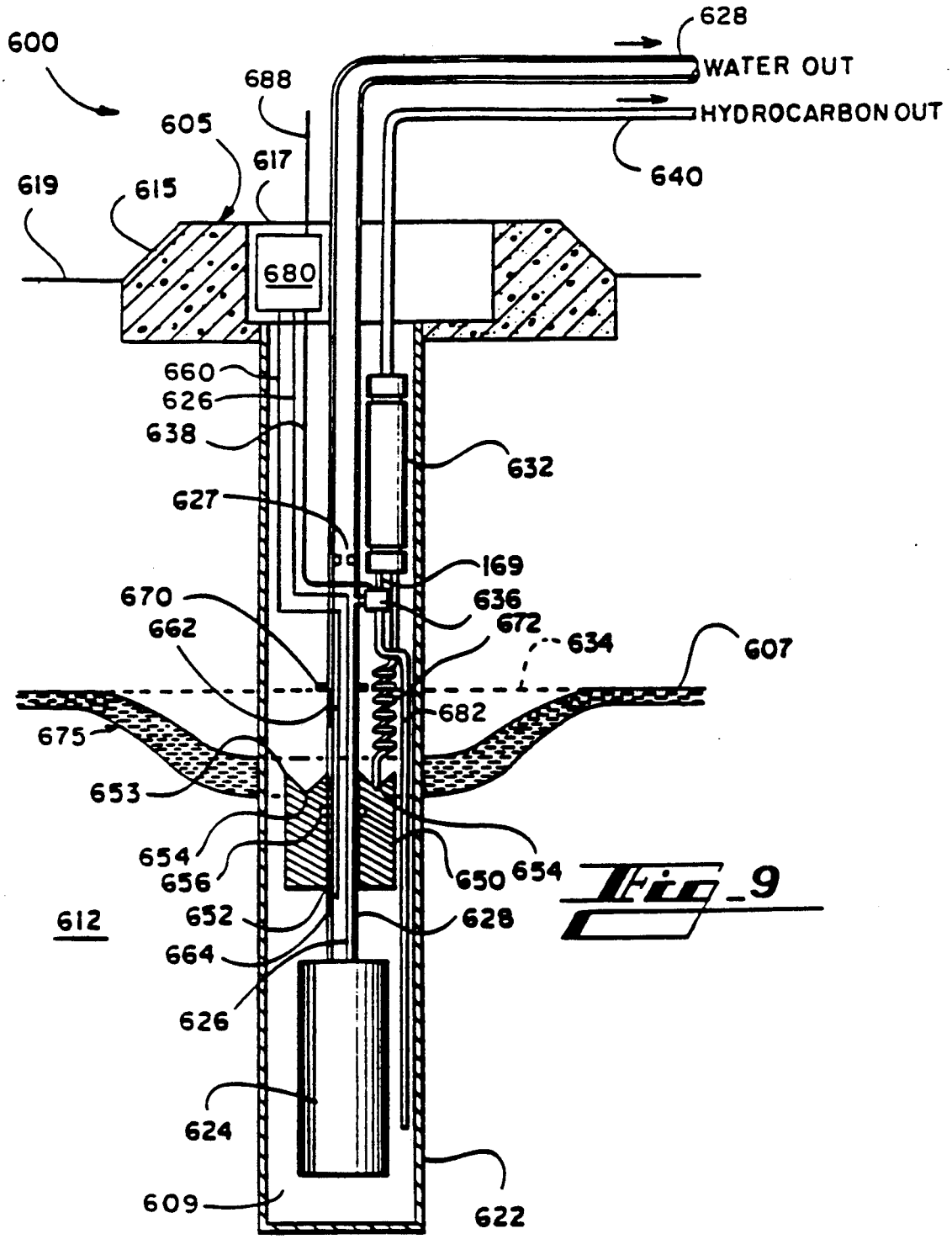
FIG. 9 is a sectioned side elevation view of a preferred embodiment of an extraction pump system of the present invention wherein water pressure from a submersible pump drives a preferred embodiment of the bladder pump of the present invention.

Turning to FIG. 9, an extraction pump system 600 is shown comprising a well 605 for removing a layer of contaminating liquid hydrocarbons 607 from the ground water 609 in an aquifer 612. The well 605 comprises a concrete vault 615 surrounding a control compartment 617 with an electric controller 680 at the surface 619. The controller 680 is powered through line 688 and provides control signals in conventional fashion on lines 626 and 638 in response to level sense signals on line 660. The well 605 also comprises a perforated well casing 622 which extends below the concrete vault 615 into the aquifer 612 containing the ground water 609 and the contaminating liquid hydrocarbons 607.

The extraction system 600 also comprises a turbine or centrifugal submersible electric pump 624 positioned below the layer of liquid hydrocarbons 607 and within the ground water 609. A discharge pipe 628 extends from the submersible pump 624 to the ground surface 619. An electrical cable 626 runs from the controller 680 at the surface 619 to the submersible pump 624 to provide power for the submersible pump.

A bladder pump 632 is fixed against the discharge pipe 628 above the level of the static water table 634 of ground water in the aquifer 612. The bladder pump 632 is identical to the bladder pump 10 shown in FIGS. 1 and 2 but it is oriented in an inverted position relative to the position of FIGS. 3 and 8 whereby the pump fluid passage 99 for the pump fluid extends through the lower intake head; instead of through the discharge head. A restrictor 627 is located in the discharge pipe so that pressure can be built up between the pump 624 and the restrictor. A three-way normally-closed valve 636 is mounted to the discharge pipe 628 below the restrictor 627, below the bladder pump 632, and above the static water table 634. The three-way valve 636 connects the pump fluid conduit 169 to the discharge pipe 628 at a point below the restrictor 627 where the discharge pressure in pipe 628 is greatest. The three-way valve has an exhaust pipe 682 which extends to beneath the surface of the water in the well bore. The three-way valve 636 is connected to an electric timer in controller 680 with an on/off sequencer through electric line 638. The three-way valve 636 alternately connects the pump fluid conduit 169 of bladder pump 632 to the discharge pipe 628 and the exhaust pipe 682 to alternatively collapse and release the inner tube of bladder pump 632. A hydrocarbon discharge tube 640 extends from the bladder pump 632 to the ground surface 619 for discharging liquid hydrocarbons.

The extraction system 600 also comprises a skimmer 650 which comprises a block of material having a specific gravity slightly less than that of water so that in its free floating condition the skimmer has its top edge 653 just above the surface of the ground water. A central passage 652 runs from the top of the skimmer 650, through the skimming vessel to the bottom of the skimming vessel. A V-shaped or concave trough 654 in the top of the skimming vessel 650 runs around the central passage 652 and the trough is bounded by edge 653. A ring magnet 656 is embedded into the skimming vessel and runs around the central passage 652 just below the V-shaped trough 654. The discharge pipe 628 fits through the central passage 652 of the skimmer 650 so that the skimmer can move up and down the discharge pipe as the skimmer floats in the ground water 609 in the well casing 622.

A level sensor cable 660 runs along the discharge pipe 626 from the controller 680 at the surface 619 to a position approximate the submersible pump 624. The level sensor cable 660 includes two magnetic reed switches 662 and 664. The first magnetic reed switch 662 is located at the level of the static water table 634 and the second magnetic reed switch 664 is located above the submersible pump 624 at a distance from the submersible pump equal to the distance from the bottom of the skimmer 650 to the ring magnet 656. The first magnetic reed switch 662 signals the controller 680 to turn the bladder pump 632 on and off through the three-way valve 636. The second magnetic reed switch 664 signals the controller 680 to turn the submersible electrical pump 624 on and off. A stop 670 is fixed to the discharge pipe at the static water line 634 in the aquifer 612.

Magnetic reed switches are well known to those skilled in the art and are commercially available under the brand name Gems control switches and are manufactured by Imo Delaval, Inc. of Plainville, Conn.

A coiled tube 672 extends from the intake shaft of the bladder pump 632 into the trough 654 in the skimmer 650.

When the submersible pump 624, the skimmer 650, the bladder pump 632, and the other equipment mounted to the discharge pipe 628 are lowered into the well casing 622, the skimmer rests against the top of the submersible pump and the ring magnet 656 is positioned adjacent the second magnetic reed switch 664. The magnetic field of the ring magnet 656 turns the second magnetic reed switch 664 to the off position, thereby signaling the controller 680 to turn off the electrical power to the submersible pump 624.

When the well 600 is initially completely installed, the skimmer 650, having a specific gravity less than that of water, floats immediately upwardly along the discharge pipe 626 until the top of the skimming vessel comes to rest against the stop 670. As the skimming vessel 650 rises the ring magnet 656 rises above the second magnetic reed switch 664, allowing the second magnetic reed switch to turn on and signal the controller to activate the submersible pump 624. Also, when the top of the skimming vessel 650 reaches the stop 670 the ring magnet 656 is positioned adjacent the first magnetic reed switch 662 and the magnetic field of the ring magnetic 656 turns the first magnet reed switch to the off position and signals the controller to close the three-way valve 636, so that water pumped by the submersible pump 624 can not flow from the discharge pipe 628 through the three-way valve 636 and into the bladder pump 632.

The submersible pump 624, while operating, removes more ground water from the aquifer 612 through the discharge pipe 628 to the surface 619 than the aquifer can supply to the well casing 622. Accordingly, as the submersible pump 624 operates to lower the level of the ground water 609 in the well casing 622 a cone of depression 675 is created. As the level of the ground water 609 drops, the skimming vessel 650 floats downwardly along the discharge pipe 628 with the ground water, and the liquid hydrocarbons 607 flow toward the center of the cone of depression 675. As the layer of liquid hydrocarbons 607 thickens at the cone of depression 675 the liquid hydrocarbons begin to flow into the trough 654 in the top of the skimmer 650. The ring magnet 656 drops below the first magnetic reed switch 662 as the skimming vessel 650 drops downwardly. When the magnetic field of the ring magnet 656 is removed from the first magnetic reed switch 662, the first magnetic reed switch turns on and signals the controller to allow pulses of ground water pumped by the submersible pump 624 from the discharge pipe 628 through the three-way valve 636, through the pump fluid conduit 169 into the outer chamber 80 of the bladder pump 632. The restrictor 627 in the discharge pipe 626 creates enough pressure in the discharge pipe 628 to force the gound water through the three-way valve 636 and into the outer chamber 80 of the elastic rebound pump 632 to collapse the inner tube 50 of the elastic rebound pump from the full configuration to the collapsed configuration. The three-way valve 636, while turned on by the first magnetic reed switch 662, produces timed pulses of ground water from the discharge pipe to the bladder pump 632. After each pulse of ground water the three-way valve 636 blocks the flow of ground water from the discharge pipe 628 and allows the ground water in the bladder pump 632 to flow back out the pump fluid conduit 169 into the well casing 622 from exhaust pipe 682. The timed pulses of pressurized ground water from the three-way valve 636 cause the inner tube 50 of the bladder pump 632 to oscillate, thus driving the bladder pump. The elastic rebound pump draws the liquid hydrocarbons 607 from the trough 654 of the skimmer 650, through the coiled tube 672 and then out the discharge tube 640 to the surface 619.

The second magnetic reed switch 664 also operates to prevent the submersible pump 624 from pumping the liquid hydrocarbons 607 with the ground water 609 through the discharge pipe 628 to the surface 619. As the submersible pump 624 continues to remove ground water 609 from the well casing 622, the cone of depression 675 continues to drop along with the skimmer 650 until the ring magnet 656 of the skimmer reaches the second magnetic reed switch 664 and turns off the submersible pump 624. When the submersible pump 624 is turned off, the level of the ground water rises in the well casing 622 until the ring magnet 656 rises above the second reed switch 664 and the submersible pump turns on again. Accordingly, the layer of liquid hydrocarbons 607 never passes below the second reed switch 664 and cannot be pumped by the submersible pump 624 with the ground water 609.

The first magnetic reed switch 662 also operates to prevent the bladder pump 632 from drawing ground water along with or instead of liquid hydrocarbons. Before the submersible pump 624 has created the cone of depression 675, the level of the ground water is even with the static water table 634 and the layer of liquid hydrocarbons is normally too thin to fill the trough 654 in the skimmer 650, allowing ground water to flow into the trough. However, when the ground water level is even with the static water table 634, the ring magnet 656 in the skimmer 650 is adjacent the first magnetic reed switch 662 and the elastic rebound pump 632 is turned off. Only when the cone of depression 675 is created and the skimmer 650 and the ring magnet 656 drop below the first magnetic reed switch does the bladder pump 632 turn on. When the cone of depression 675 is created, the layer of liquid hydrocarbons 607 is thick enough so that the trough 654 in the skimmer fills with liquid hydrocarbons.

It should be understood that the foregoing relates only to preferred embodiments of the present invention, and that numerous changes and modifications therein may be made without departing from the spirit and scope of the invention as defined by the following claims.

I claim:

1. A skimming means for skimming floating liquid hydrocarbons off of the surface of underlying ground water in a well bore, the skimming means comprises a perforated outer container with an enclosed top and bottom, a pipe fixed to and extending through the top from a point above the top to a mid point within the outer container, the pipe and container together having a greater than neutral buoyancy in the ground water so that the top of the outer container is located above the liquid hydrocarbon layer, an inner vessel, having an open top, and positioned within the outer container and surrounding the pipe, the inner vessel having greater than neutral buoyancy in the ground water so that its open top extends above the surface of the ground water and is located within the layer of liquid hydrocarbons.

2. A skimming means for skimming floating liquid hydrocarbons off of the surface of underlying ground water in a well bore, the skimming means comprises a slug with a top concave surface, with a top outer edge, and with a collector located within the top concave surface, and wherein the slug has a neutral buoyancy in the ground water so that the outer edge of the top surface is located adjacent the surface of the underlying ground water within a liquid hydrocarbon layer, the collector comprising a connector with inlet holes secured to the center of the concave surface and having a coiled tube attached thereto for providing spring action to help assure the top outer edge is maintained within the liquid hydrocarbon layer; the concave surface being free of any cover and being fully exposed to the liquid hydrocarbon layer.

3. The skimming means of claim 2, wherein the slug is cylindrical with a bottom edge and is elongated and wherein the top and bottom edges are rounded.

4. A skimming means for skimming floating liquid hydrocarbons off of the surface of the underlying water, wherein the skimming means comprises a saucer having a top concave surface, with a top outer edge, and with a collector located within the top concave surface and having an upset baffle extending around the outer edge with spaced openings adjacent the top surface, wherein the saucer has a neutral buoyancy in water so that the top edge is located just above the surface of the ground water within a liquid hydrocarbon layer;

the collector being joined to the underside of the top surface to allow liquid hydrocarbon that enters through the spaced openings to exit the saucer by down flow through the collector;

the top surface being protected from waves by the upset baffle whose upper edge normally extends above the liquid surface.

5. Apparatus for pumping liquid comprising:

a flexible inner tube having a substantial elastic rebound defining an inner chamber having an inlet opening and an outlet opening;

a pump housing surrounding the inner tube in spaced relation to the inner tube defining an outer chamber for confining pump fluid;

first means for permitting liquid flow unidirectionally through the inlet opening of the inner tube into the inner chamber;

second means for permitting liquid flow unidirectionally through the outlet opening of the inner tube from the inner chamber; and means for selectively allowing the pump fluid into the outer chamber, the pump fluid having a high pressure sufficient to collapse the inner tube from a full configuration to a collapsed configuration, whereby liquid in the inner chamber is discharged from the inner chamber through the second flow permitting means, and alternately, releasing pump fluid from the outer chamber to restore atmospheric pressure therein, thereby allowing the inner tube to rebound from the collapsed configuration to the full configuration, whereby liquid is drawn into the inner chamber through the first flow permitting means, and wherein the elastic rebound of the inner tube is sufficient to create a vacuum pressure at the first flow permitting means of greater than 5 feet of water.

6. Apparatus for pumping liquid as in claim 5, wherein:

the inner tube comprises neoprene.

7. Apparatus for pumping liquid, comprising:

a flexible inner tube having a substantial elastic rebound defining an inner chamber and having an inlet head with an inlet opening and an outlet head with an outlet opening so that liquid can flow through the inner tube;

an outer tube extending from the inlet head to the outlet head and surrounding the inner tube in spaced relation to the inner tube defining an outer chamber for confining a pump fluid;

an inlet valve operable to permit liquid flow unidirectionally through the inlet opening of the inlet head into the inner chamber;

an outlet valve operable to permit liquid flow unidirectionally through the outlet opening of the outlet head from the inner chamber; and a conduit for selectively allowing pump fluid into the outer chamber, the pump fluid having a high pressure sufficient to collapse the flexible inner tube from a full configuration to a collapsed configuration, whereby liquid in the inner chamber is discharged from the inner chamber through the outlet valve, and alternately, releasing pump fluid from the outer chamber to restore atmospheric pressure therein, thereby allowing the inner tube to rebound from the collapsed configuration, to the full configuration whereby liquid is drawn into the inner chamber through the inlet valve, and wherein the elastic rebound of the inner tube is sufficient to create a vacuum pressure at the inlet valve of greater than 5 feet of water.

8. Apparatus for pumping liquid as in claim 7, wherein:

the outer tube comprises neoprene.

9. An extraction pump system for recovery of liquid hydrocarbons in a layer floating on the surface of ground water in a well bore, comprising:

a pump suspended in the bore to a position above the liquid hydrocarbons, comprising:

(i) a flexible inner tube having a substantial elastic rebound defining an inner chamber having an inlet opening and an outlet opening;

(ii) a pump housing surrounding the inner tube in spaced relation to the inner tube, defining an outer chamber for confining pump fluid;

(iii) first means for permitting liquid hydrocarbon flow unidirectionally through the inlet opening of the inner tube into the inner chamber;

(iv) second means for permitting liquid hydrocarbon flow unidirectionally through the outlet opening of the inner tube from the inner chamber;

(v) means for conducting the liquid hydrocarbons to the first flow permitting means; and (vi) means for selectively allowing pump fluid into the outer chamber, the pump fluid having a high pressure sufficient to collapse the inner tube from a full configuration to a collapsed configuration, whereby liquid hydrocarbons in the inner chamber are discharged from the inner chamber through the second flow permitting means, and alternately, releasing pump fluid from the outer chamber, to restore atmospheric pressure therein, thereby allowing the inner tube to rebound from the collapsed configuration to the full configuration, whereby liquid hydrocarbons are drawn into the inner chamber through the first flow permitting means.

10. An extraction pump system as in claim 9, wherein: the inner tube comprises neoprene.

11. A pump system for recovering liquid hydrocarbons from ground water comprising:

a recovery pump comprising an inner tube arranged within an outer tube, the inner tube comprising a synthetic rubber material resistant to corrosion by liquid hydrocarbons and characterized by having substantial elastic rebound, an intake conduit and a discharge conduit at respective ends of an inner chamber of the inner tube with respective check valves therein, and a pump fluid passage from exterior of the pump to an outer chamber between the inner and outer tubes;

the pump being arranged in a well casing with an outer end of the intake conduit in fluid communication with a liquid hydrocarbon layer;

pump fluid supply and control apparatus for supplying pump fluid in pulses through the pump fluid passage to the outer chamber at a high pressure to collapse the inner tube and force its contents out through the discharge conduit and, after a pulse of pump fluid ends, to restore atmospheric pressure to the outer chamber and allow the inner tube to snap back to a full configuration by elastic rebound inducing a low pressure in the inner chamber that draws in liquid hydrocarbon through the intake conduit.

12. A method for recovering liquid hydrocarbons from ground water comprising:

arranging a recovery pump in a well casing extending into an aquifer, the pump having an inner tube with substantial elastic rebound within an outer tube the inner tube having an inner chamber with an intake conduit and a discharge conduit at respective ends thereof, each conduit having an associated check valve, the pump also having a pump fluid passage from exterior of the pump to an outer chamber between the inner and outer tubes;

arranging the intake conduit in fluid communication with a liquid hydrocarbon layer within the well casing and the discharge conduit in fluid communication with ground surface above the aquifer;

supplying pump fluid in pulses through the pump fluid passage to the outer chamber at a high pressure to collapse the inner tube and to force contents of the inner chamber out through the discharge conduit and, after a pulse of pump fluid ends, rapidly relieving pressure in the outer chamber to restore atmospheric pressure therein and allowing the inner tube to return to full configuration by elastic rebound thereupon producing a low. pressure in the inner chamber and drawing liquid hydrocarbon through the intake conduit.

13. The method of claim 12 wherein:

the step of rapidly relieving pressure in the outer chamber returns the outer chamber to atmospheric pressure.

14. Skimmer apparatus for use with an extraction pump comprising:

a cylindrical slug with a top surface bounded by a top outer edge;

a connector for joining a conduit to the slug and arranged for receiving a liquid that flows over the top outer edge onto the top surface;

the slug having a buoyancy so that the top outer edge is located adjacent the surface of the liquid when left free to float;

a conduit attached at one end to the slug by the connector, the conduit being a coiled flexible tube with another end for attachment to a recovery pump, the coiled tube exhibiting a spring action so that, when the slug is suspended by the coiled tube in water with a liquid hydrocarbon layer on its surface, the coiled tube acts as a spring that pulls the slug up to place the top outer edge of the slug in the liquid hydrocarbon layer;

the top surface being free of any cover and being fully exposed to the liquid hydrocarbon layer.

15. A bladder type pump and controls therefore comprising:

a pump housing containing a flexible inner bladder that defines, in cooperation with an intake head and a discharge head, a first, inner, chamber for a first, pumped, fluid and a second, outer, chamber, between the pump housing and the bladder for a second, pumping, fluid;

the flexible inner bladder being characterized by a high degree of elastic rebound so that a pressure change of the pumping fluid in the outer chamber from a high pressure to atmospheric pressure, without other mechanical assistance, results in rapid expansion of the inner chamber by elastic rebound, formation of a low pressure in the inner chamber, and intake of pumped fluid through the intake head;

means for controlling the operation of the pump comprising means for applying a series of pulses of pumping fluid to the outer chamber with a duration of each pulse sufficient to collapse the inner chamber and force pumped fluid out of the discharge head and an interval between the pulses sufficient to allow the inner chamber to return to full configuration.

16. A bladder type pump and controls therefor in accordance with claim 15 wherein:

the pump housing and the inner bladder are elongated tubular members of relatively close dimensions so the housing can fit within a limited size well casing and yet the bladder has an inner chamber of sufficient volume for taking in a useful quantity of pumped fluid in a pulse interval.

17. A bladder type pump and controls therefor in accordance with claim 16 wherein:

the pump housing is a flexible tube and it may be coiled.

18. A bladder type pump and controls therefor in accordance with claim 15 wherein:

the means for controlling the operation of the pump comprises a source of compressed pumping fluid at constant pressure, a timing circuit with a valve, an on-time restrictor and an off-time restrictor, means for alternately connecting the source of compressed pumping fluid to the pump outer chamber and to an exhaust port in accordance with action of the timing circuit.

19. A bladder type pump and controls therefor in accordance with claim 18 wherein:

the means for controlling further comprises a sensing circuit that senses presence of the first fluid to be pumped before the means for controlling allows fluid pulses to be applied to the pump.

20. A skimmer apparatus for skimming a floating liquid off the surface of an underlying liquid comprising:

a perforated outer container having a top with a fluid conduit joined to the outer container and having an intake end within the outer container, the buoyancy of the outer container and fluid conduit being so the top of the container is above the floating liquid;

an inner vessel, positioned within and not joined to the outer container, with an opening, and having a buoyancy so an edge of the opening is located within the floating liquid; and the intake end of the fluid conduit is within the inner vessel.

* * * * *

UNITED STATES PATENT AND TRADEMARK OFFICE

CERTIFICATE OF CORRECTION

PATENT NO. : 5,058,669

DATED : October 22, 1991

INVENTOR(S) : Samuel L. Wells

It is certified that error appears in the above-identified patent and that said Letters Patent is hereby corrected as shown below:

The title page showing the illustrative figures and Drawing Sheets 1-6, should be deleted and substitute therefor the attached title page and Drawing Sheets 1-8, consisting of figures 1-11.

Signed and Sealed this

Twenty-eighth Day of July, 1992

*Attest:*

DOUGLAS B. COMER

*Attesting Officer*

*Acting Commissioner of Patents and Trademarks*

United States Patent [19]

Wells

[11] Patent Number: 5,058,669

[45] Date of Patent: Oct. 22, 1991

[54] EXTRACTION SYSTEM WITH A PUMP HAVING AN ELASTIC REBOUND INNER TUBE

[75] Inventor: Samuel L. Wells, Lilburn, Ga.

[73] Assignee: Westinghouse Electric Corp., Pittsburgh, Pa.

[21] Appl. No.: 581,939

[22] Filed: Sep. 13, 1990

Related U.S. Application Data

[63] Continuation of Ser. No. 326,368, Mar. 21, 1989, Pat. No. 4,974,674.

[51] Int. Cl.[5] ..... E21B 43/00

[52] U.S. Cl. ..... 166/107; 166/167; 417/478; 210/242.3

[58] Field of Search ..... 166/54.1, 105, 107, 166/165, 167, 105.6, 166; 417/394, 478, 479; 210/242.3

[56] References Cited

U.S. PATENT DOCUMENTS

| | | | |
|---|---|---|---|
| 3,690,463 | 9/1972 | O'Brien | 210/242.3 |
| 4,257,751 | 3/1981 | Kofahl | 417/394 |

FOREIGN PATENT DOCUMENTS

| | | | |
|---|---|---|---|
| 2410093 | 7/1979 | France | 210/242.3 |
| 0005974 | 10/1987 | PCT Int'l Appl. | 417/478 |

*Primary Examiner*—Terry L. Melius
*Attorney, Agent, or Firm*—G. H. Telfer

[57] ABSTRACT

An elastic rebound pump comprises a flexible inner tube having a substantial elastic rebound surrounded by a pump housing. The inner tube defines an inner chamber and the pump housing forms an outer chamber for confining a pump fluid. The pump allows pressurized gas or hydraulic fluid into the outer chamber to collapse the inner tube thereby discharging liquid from the inner chamber through an outlet opening. The pump alternatively releases the pressurized fluid from the outer chamber thereby allowing the inner tube to rebound to a full configuration and draw liquid into the inner chamber through the inlet opening. By repeatedly allowing pump fluid into the outer chamber and sequentially releasing the pump fluid from the outer chamber, the pump produces a substantially steady flow of liquid. An extraction pump system includes the elastic rebound pump for removing liquid hydrocarbons from ground water collected in a well. The elastic rebound pump fits easily into small diameter wells and can be suspended above the liquid hydrocarbons in the well. An alternative extraction pump system includes a submerisble pneumatic pump positioned within the ground water in the well for creating a cone of depression, and the elastic rebound pump and the submersible pump are driven simultaneously. In another disclosed extraction pump system, the elastic rebound pump is suspended within the housing of the submerged pneumatic pump. In still another disclosed extraction pump system, the elastic rebound pump is driven with pressurized ground water from a submersible pump.

20 Claims, 6 Drawing Sheets

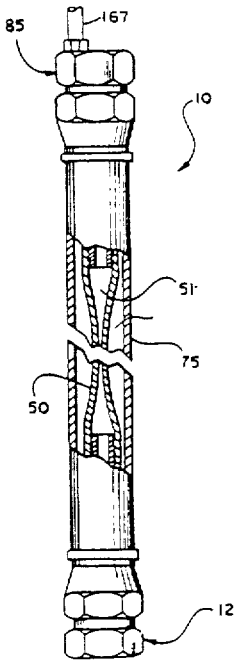

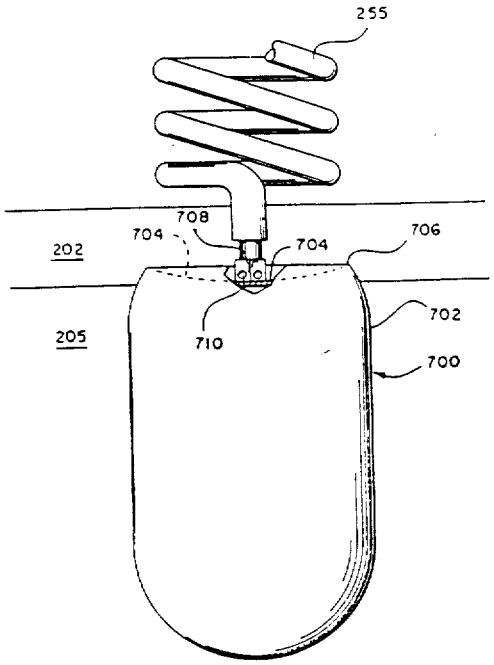

Fig. 6
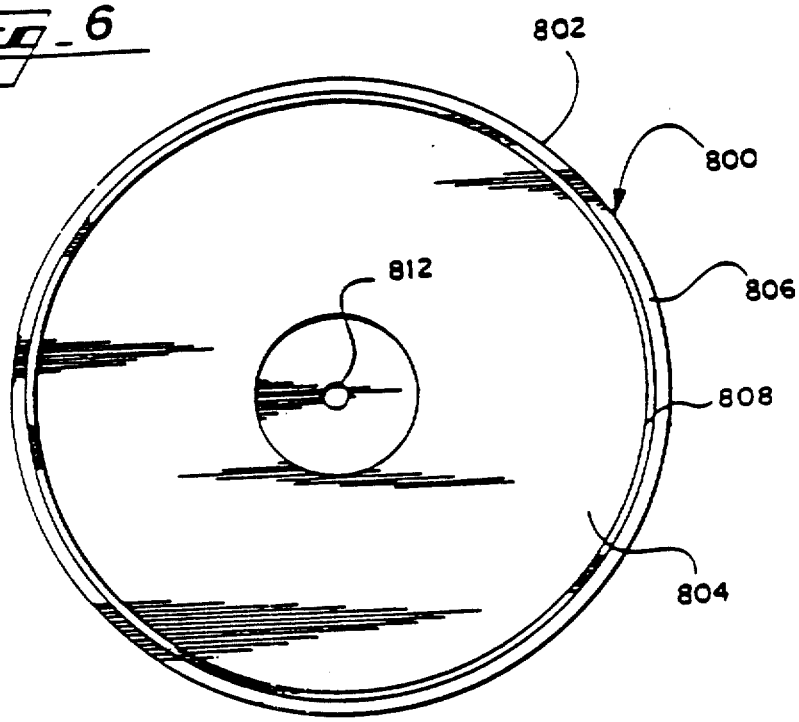
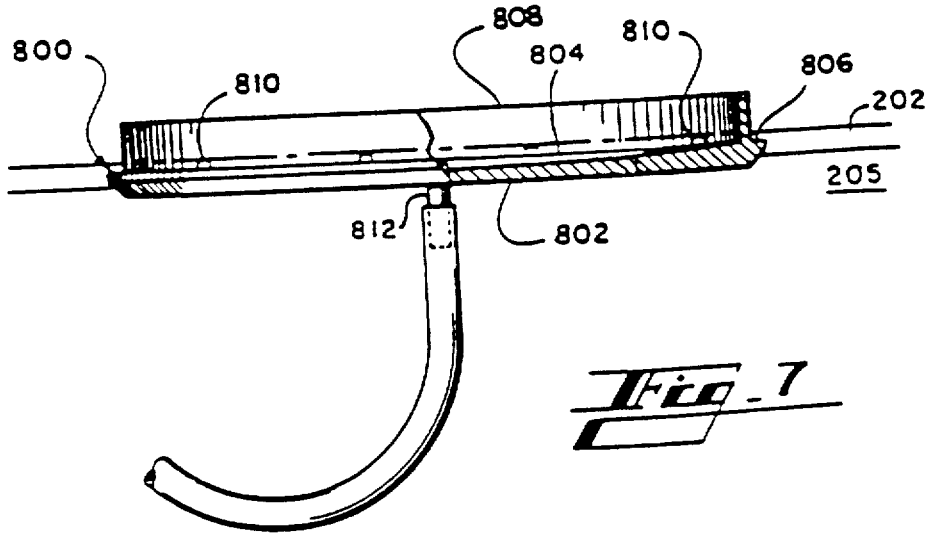
Fig. 7